US007339542B2

(12) United States Patent
Lalezari

(10) Patent No.: US 7,339,542 B2
(45) Date of Patent: Mar. 4, 2008

(54) ULTRA-BROADBAND ANTENNA SYSTEM COMBINING AN ASYMMETRICAL DIPOLE AND A BICONICAL DIPOLE TO FORM A MONOPOLE

(75) Inventor: Farzin Lalezari, Boulder, CO (US)

(73) Assignee: FIRST RF Corporation, Boulder, CO (US)

( * ) Notice: Subject to any disclaimer, the term of this patent is extended or adjusted under 35 U.S.C. 154(b) by 232 days.

(21) Appl. No.: 11/298,482

(22) Filed: Dec. 12, 2005

(65) Prior Publication Data

US 2007/0132650 A1 Jun. 14, 2007

(51) Int. Cl.
*H01Q 13/00* (2006.01)

(52) U.S. Cl. ..... 343/773; 343/730; 343/792

(58) Field of Classification Search ..... 343/725, 343/729, 730, 756, 773, 774, 790, 791, 792, 343/793

See application file for complete search history.

(56) References Cited

U.S. PATENT DOCUMENTS

| | | | | |
|---|---|---|---|---|
| 2,267,889 | A | 12/1941 | Aubert | |
| 2,532,551 | A * | 12/1950 | Jarvis | 343/774 |
| 3,829,863 | A * | 8/1974 | Lipsky | 343/773 |
| 4,115,783 | A | 9/1978 | Reggia | |
| 4,125,840 | A | 11/1978 | Cassel | |
| 4,225,869 | A * | 9/1980 | Lohrmann | 343/773 |
| 4,496,953 | A | 1/1985 | Spinks, Jr. et al. | |
| 4,513,290 | A | 4/1985 | Lefevre et al. | |
| 4,633,265 | A | 12/1986 | Wheeler | |
| 4,835,542 | A | 5/1989 | Sikina, Jr. | |
| 4,959,657 | A * | 9/1990 | Mochizuki | 343/725 |
| 5,111,213 | A | 5/1992 | Jahoda et al. | |
| 5,134,420 | A * | 7/1992 | Rosen et al. | 343/756 |
| 5,257,032 | A | 10/1993 | Diamond et al. | |
| 5,367,312 | A | 11/1994 | Masters | |
| 5,644,321 | A | 7/1997 | Benham | |
| 5,892,486 | A | 4/1999 | Cook et al. | |
| 6,154,182 | A | 11/2000 | McLean | |
| 6,239,765 | B1 | 5/2001 | Johnson et al. | |
| 6,642,899 | B2 * | 11/2003 | Strickland et al. | 343/773 |
| 6,667,721 | B1 | 12/2003 | Simonds | |
| 6,693,600 | B1 | 2/2004 | Elliot | |
| 6,768,461 | B2 | 7/2004 | Huebner et al. | |

(Continued)

OTHER PUBLICATIONS

Oct. 1950, R. W. P. King, "Asymmetrically Driven Antennas and the Sleeve Dipole," Proc. IRE, vol. 38, pp. 1154-1164.

(Continued)

*Primary Examiner*—Tho Phan
(74) *Attorney, Agent, or Firm*—Intelle Tech PLLC; Katharine I. Matthews

(57) ABSTRACT

An ultra-broadband antenna system is disclosed. The antenna system is a single tubular antenna structure comprising an asymmetrical dipole fed with a biconical dipole. The biconical dipole covers the high frequency spectrum, while the asymmetrical dipole covers intermediate frequencies. The invention further relates to a combination of the two dipole structures such that together they act as a monopole to cover the low frequency spectrum. A first RF connector attaches to the asymmetrical dipole and the biconical dipole, and a second RF connector excites the combination of the two dipoles as one large monopole. A choke minimizes interference between the asymmetrical/biconical dipoles and the monopole. The resulting frequency span is greater than 500:1, providing operation over the range of 20 MHz to 10 GHz.

21 Claims, 18 Drawing Sheets

U.S. PATENT DOCUMENTS

| | | | | |
|---|---|---|---|---|
| 6,822,621 | B2 | 11/2004 | Lamour et al. | |
| 6,864,853 | B2 * | 3/2005 | Judd et al. | 343/844 |
| 6,919,851 | B2 | 7/2005 | Rogers et al. | |

OTHER PUBLICATIONS

1952, S. A. Schelkunoff and H. T. Friis, Antennas: Theory and Practice. New York: John Wiley & Sons, Inc., pp. 304-307 and 424-431.

Sep. 1965, R. W. P. King and T. T. Wu, "The Cylindrical Antenna with Arbitrary Driving Point," IEEE Trans. Antennas Propagat., vol. AP-13, No. 5, pp. 710-718.

Jun. 1966, S. R. Seshadri and T. T. Wu, "The Integral Equation for the Current in an Asymmetrically Driving, Thick Tubular Antenna," Cruft Lab, Harvard University, Cambridge, MA, Tech. Rep. 503.

Nov. 1966, C. W. Harrison, Jr., C. D. Taylor, E. A. Aronson and E. E. O'Donnell, "On the Driving Point Impedance of an Asymmetrical Dipole," IEEE Trans. Antennas Propagat., vol. AP-14, pp. 794-795.

Jan. 1971, B. D. Popović, "On Polynomial Approximation of Current Along Thin Asymmetrical Cylindrical Dipoles," IEEE Trans. Antennas Propagat., vol. AP-19, No. 1, pp. 117-120.

May 1974, K. Al-Badwaihy and J. Yen, "Hemispherically Capped Thick Cylindrical Monopole with A Conical Feed Section," IEEE Trans. Antennas Propagat., vol. AP-22, No. 3, pp. 477-481.

2002, J. D. Kraus and R. J. Marhefka, Antennas: For All Applications, 3rd ed. New York: McGraw-Hill, pp. 470-472.

* cited by examiner

200 MHz

500 MHz

1000 MHz

2500 MHz

ULTRA-BROADBAND ANTENNA SYSTEM COMBINING AN ASYMMETRICAL DIPOLE AND A BICONICAL DIPOLE TO FORM A MONOPOLE

FIELD OF THE INVENTION

The present invention relates to an ultra-broadband antenna system, and more particularly, to a single tubular antenna structure comprising an asymmetrical dipole fed with a biconical dipole. The biconical dipole covers the high frequency spectrum, while the asymmetrical dipole covers intermediate frequencies. The invention further relates to a combination of the two dipole structures such that together they act as a monopole to cover the low frequency spectrum. The resulting frequency span is greater than 500:1.

BACKGROUND OF THE INVENTION

In the second millennium, electronic devices are ubiquitous, and it is certain that the number, variety and sophistication will continue to proliferate. Many of these universally available electronic devices employ radio frequency (RF) signals, including radios, televisions, cellular phones, computers, etc. In addition, more and more electronic devices are now activated by remote controls or wireless modems that transmit and receive RF signals, for example, automobiles, garage doors, cordless phones, fireplaces, toasters, microwave ovens, etc.

Consequently, there exist a multiplicity of antennas that are used to transmit and receive the various RF signals. Some antennas are designed to maximize transmission over distance (such as for satellite or airplane communication), others are designed to be low-profile for high speed and high turbulence applications (such as for airplanes or ships), while others are designed to be as small and compact as possible (such as for remote control devices or RFID tags).

Typically, these antennas are intended to transmit and receive signals having frequencies within a defined range, and the dimensions and geometry of a particular antenna limit its usefulness to a relatively narrow band of frequencies. For certain applications, however, it may be desirable to be able to monitor a wider band of frequencies. In many commercial and government applications, for example, there is a need to communicate via many different radios operating at several bands of interest. Antennas in common vehicular applications now cover cellular phones operating at 1000, 1800 and 2500 MHz; radios in VHF and UHF bands operating at 20-500 MHz; other entertainment bands, such as TV, operating at 100-600 MHz; and garage door openers operating at ~200-400 MHz. In addition to the above, government vehicles may have requirements to communicate via a range of secure RF bands in very wide frequency range, for example from 20 MHz-10 GHz. The antenna system of the present invention provides coverage over this entire frequency range.

Broadband antennas, or those capable at operating at more than one range of frequencies, are well known, but typically have less desirable gain characteristics than narrow-band antennas. For applications requiring acceptable gain at a variety of frequency bands, multiple-antenna devices have been developed. A drawback to the multiple-antenna approach, however, is that such a device takes up more space at its point of attachment and may be more complicated and fragile than single antenna designs. This may not be acceptable, for example, in mobile applications. An advantage of present invention is that it is packaged as a single antenna, and as such is compact, robust and has a small footprint, allowing it to be easily attached to a wide range of substrates, including vehicles.

Other approaches to broadband antenna design include using a single broadband antenna such as a biconical that extends the entire frequency band, or using a frequency independent antenna such a spiral. A problem with both of these approaches is that as the frequency range expands, the antenna dimensions become increasingly large in diameter. For certain applications, an excessively large diameter antenna is impractical or even impossible. A novel feature of the present invention is the tubular shape of the antenna system, having a relatively small diameter that allows packaging of the antenna for a variety of applications, including vehicular applications.

Yet another approach to providing a broadband antenna is to use a frequency tunable antenna. A tunable antenna requires information regarding the frequency band of interest in order to tune the antenna to the desired frequency. This becomes a major handicap for tunable antennas, however, when the frequency of operation of the system is not known. An example of such systems is the "frequency hopping" radio communications system, where the frequency of operation is changed to reduce interference from unwanted sources. The "frequency plan" for hopping is not always known ahead of time, which can hinder the ability of a frequency tunable antenna in receive mode to be used in hopping systems. In general, it is inconvenient and unreliable to make manual adjustments every time a frequency change is needed. Instead of manual tuning, a tunable antenna may have electrical tuning capability. A drawback of such a tunable antenna, however, is the complexity and cost of active components that are required for the adjustable tuning. The present invention overcomes all such drawbacks of tunable antennas, as it comprises a single passive structure with no active components.

An additional feature that is desirable for vehicular antenna applications is having an omni-directional capability, i.e., having a radiation pattern with adequate gain over 360 degrees of coverage in the azimuthal plane and at low elevation angles near horizon, such as when the antenna is mounted vertically on a vehicle. Vehicles on the move may change orientation rapidly, and thus it is preferable that a vehicular antenna be able to maintain communication without adjustment. The antenna system of the present invention provides such omni-directional capability, and does so over a wide bandwidth.

Another advantageous feature of the present invention is having broadband impedance characteristics that allow the antenna system to operate with common RF systems (radios). Typical voltage standing wave ratio (VSWR) of the antenna of the present invention is less than 3:1 over the 500:1 frequency span. This allows the antenna to operate in both transmit and receive modes with a relatively small degradation in performance.

Antennas that utilize dipoles, biconical structures and monopoles to achieve enhanced bandwidth are known in the art. For example, U.S. Pat. No. 4,496,953 to Spinks, Jr. et al. discloses a dipole antenna, that, like the present invention, uses couplers to couple energy from one radiator to another. In the Spinks, Jr. et al. antenna, however, energy is coupled between the two arms of the dipole, whereas in the present invention, coupling takes place in the low band to create a monopole and it is then isolated from the monopole to create an asymmetric dipole that covers the mid-band. Further, Spinks, Jr. et al. disclose a bandwidth of only approximately 2:1, much narrower than that of the present invention.

U.S. Pat. No. 4,835,542 to Sikina, Jr. discloses a biconical antenna claiming a 10:1 bandwidth, which, compared with the present invention, is only a moderately broadband antenna. The size of the Sikina, Jr. biconical antenna is determined by the lower extent of the frequency of operation, resulting in a biconical diameter that is rather large, compared to that of the present invention.

U.S. Pat. No. 5,257,032 to Diamond et al. discloses a broadband antenna system including a spiral antenna and dipole or monopole antenna. Dipole arms are added to improve the bandwidth of the broadband antenna, while a dipole or monopole antenna are added to improve performance at low frequencies. In contrast, the present invention employs an asymmetric dipole antenna and makes additional use of that structure to excite a monopole antenna. Unlike the Diamond et al. antenna which uses a single feed for each antenna, the present invention uses two separate feeds, one for each of two component antenna structures, the monopole and the combined asymmetrical/biconical dipole. Furthermore, the present invention is designed to provide an omnidirectional, vertically polarized beam. In contrast, the spiral antenna of Diamond et al. is circularly polarized, with an associated loss compared to the vertically polarized antenna of the present invention.

U.S. Pat. No. 5,892,486 to Cook et al. discloses a dipole antenna array arranged with a balun to make improvements in the bandwidth performance. Having only an approximately 1.75:1 bandwidth, this is not an ultra-broadband antenna.

U.S. Pat. No. 6,154,182 to McLean discloses a biconical antenna that is designed to have a 10:1 bandwidth. It is a wire biconical antenna to which a plate can be added or removed from the top of the antenna. Adding the plate enables performance at the low end of the band. Removing the plate improves performance at the high end of the band. This differs substantially from the present invention in that the McLean design requires manual changes to be made to the antenna to achieve the larger bandwidths. Furthermore, in order to provide extended low-end performance, the McLean-antenna become large in diameter, similar to the Sikina, Jr. antenna described above.

U.S. Pat. No. 6,239,765 to Johnson et al. discloses an asymmetric dipole antenna assembly. Unlike the present invention, this antenna is printed and is not a broadband antenna.

U.S. Pat. No. 6,667,721 to Simonds discloses an antenna consisting of a bicone with exponentially tapered reflector fins. This antenna has a 135:1 bandwidth (FIG. 4 levels below −10 dB) and like the present invention, uses a bicone antenna to match the impedance. While the Simonds antenna has a performance similar to that of the present invention, its design is significantly different in that it does not integrate any additional antennas to the bicone to improve the performance. Further, in order to achieve the disclosed low-band performance, the Simonds antenna design substantially exceeds the diameter of the present invention. Simonds discloses that "the fins function to reduce the traditional bicone antenna diameter," yet the bicone extends in width and results in an overall width-to-height aspect ratio of approximately 1. In contrast, the present invention is designed to achieve a similar performance with an aspect ratio of only 0.1 (10%).

U.S. Pat. No. 6,693,600 to Elliot discloses a wire monocone and an additional radiator (which may be a large monopole) to provide increased bandwidth of approximately 4:1 (FIG. 8 levels below −10 dB). Unlike the present invention, which integrates a monopole and an asymmetric dipole with biconical feeds and provides two feeds, the Elliot antenna uses a single cone, integrates it with a monopole and provides a single feed point. In further contrast with the present invention, the Elliot antenna has a wide aspect ratio like that of the Sikina, Jr. and Simonds antennas.

U.S. Pat. No. 6,919,851 to Rogers et al. discloses a thin broadband monopole/dipole antenna that uses lumped circuits to increase the bandwidth of the antenna. Unlike the present invention, no combining or conical feed sections are used.

U.S. Published Pat. Application No. 2003/0034932 to Huebner et al. discloses a planar monopole above a coplanar rectangular sheet. The sheet is connected to ground and the antenna is excited using a coaxial feed. The Rogers et al. antenna may also be viewed as an asymmetrical planar dipole. This antenna has a 5:1 bandwidth, whereas the present invention has a much larger bandwidth.

As described above, antennas known in the art lack the combination of advantages found in the antenna system of the present invention. The need exists, therefore, for an antenna capable of operating over a wide range of frequencies that is compact, robust, occupies a relatively small footprint—all with a narrow aspect ratio. The present invention provides these features in a single tubular antenna structure that, because of the innovative combination of a biconical dipole element and an asymmetrical dipole element, also functions as a monopole. Incorporation of the monopole in this way substantially increases the low frequency performance without excessively increasing the length (height) of the overall antenna. The design of the present invention is thus an improvement over conventional dipole antennas capable of operating at the same frequencies. The present invention therefore provides ultra-broadband coverage, i.e., acceptable gain in the low frequencies, intermediate frequencies and high frequencies. As a result, the present invention has application where it is desirable to monitor the RF spectrum ranging from 20 MHz to 10 GHz.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicant has developed an innovative ultra-broadband antenna system. As illustrated in the accompanying drawings and disclosed in the accompanying claims, the invention is an ultra-broadband antenna system comprising a single tubular antenna structure, which further comprises an asymmetrical dipole antenna; a biconical dipole antenna; and a combination of the asymmetrical dipole antenna and the biconical dipole antenna such that the combination forms a monopole antenna.

The combination may further comprise a canister sub-assembly, attached to the asymmetrical dipole antenna, that provides frequency adjustment for the monopole antenna; a choke sub-assembly, provided within the canister sub-assembly, that minimizes inference between the asymmetrical dipole antenna, the biconical dipole antenna and the monopole antenna; a balun sub-assembly, provided within the asymmetrical dipole antenna, that feeds current to the asymmetrical dipole antenna and the biconical dipole antenna together via a first RF connection; a base sub-assembly, attached to the canister sub-assembly, that attaches the system to a substrate and provides a conductive path for ground return currents of the monopole antenna; and a second RF connection that feeds current to the monopole antenna.

The canister sub-assembly may further comprise a cylinder expander ring that insulates the asymmetrical dipole element and the biconical dipole element electrically from the monopole antenna, and a dielectric isolator that insulates the base sub-assembly from the monopole antenna.

As disclosed herein, the ultra-broadband antenna system provides a bandwidth greater than 500:1.

The biconical dipole antenna of the present invention may further comprise a first cone, a second cone and at least one spacer rod, and in an alternate embodiment, may comprise a first hemisphere, a second hemisphere and at least one spacer rod.

The base sub-assembly of the ultra-broadband antenna system may further comprise a conductive spring that flexibly supports the system.

In the ultra-broadband antenna system of the present invention, the first RF connection may be fed to a high-band connector and therefrom to a first transceiver, and the second RF connection may fed to a low-band connector and therefrom to a second transceiver. In an alternate embodiment, the first RF connection may be fed to a high-band connector and therefrom to a diplexer, and the second RF connection may be fed to a low-band connector and therefrom to the diplexer, so that return current flows from the diplexer via a single output connector to a transceiver.

The present invention also contemplates a method for providing an ultra-broadband antenna system, comprising the steps of providing a single tubular antenna structure; providing an asymmetrical dipole antenna contained within the antenna structure; providing a biconical dipole antenna contained within the antenna structure; and providing a combination of the asymmetrical dipole antenna and the biconical dipole antenna such that the combination forms a monopole antenna within the antenna structure.

The method of the present invention may further comprise the steps of providing a canister sub-assembly for frequency adjustment of the monopole antenna; providing a choke sub-assembly for minimizing inference between the asymmetrical dipole antenna, the biconical dipole antenna and the monopole antenna; providing a balun sub-assembly for feeding current to the asymmetrical dipole antenna and the biconical dipole antenna together via a first RF connection; and providing a base sub-assembly for attaching the system to a substrate and providing a conductive path for ground return currents of the monopole antenna; providing a second RF connection for feeding current to the monopole antenna; providing a cylinder expander ring for insulating the asymmetrical dipole element and the biconical dipole element electrically from the monopole antenna;. and providing a dielectric isolator for insulating the base sub-assembly from the monopole antenna.

The method disclosed herein of providing a ultra-broadband antenna system may further comprise the step of providing a bandwidth greater than 500:1.

The method of the present invention may further comprise the step of providing a first cone, a second cone and at least one spacer rod for generating electrical activity via the biconical dipole antenna.

The method of the present invention, in an alternate embodiment, may further comprise the step of providing a first hemisphere, a second hemisphere and at least one spacer rod for generating electrical activity via the biconical dipole antenna.

The method may further comprise the step of providing a conductive spring in the base sub-assembly for flexibly supporting the system.

In addition, the method of the present invention may further comprise the steps of providing a high-band connector for feeding the first RF connection and a first transceiver, and providing a low-band connector for feeding the second RF connection and a second transceiver.

In an alternate embodiment, the method of the present invention may further comprise the steps of providing a high-band connector for feeding the first RF connection, providing a low-band connector for feeding the second RF connection, and providing a diplexer for connecting to the high-band connector and to the low-band connector, wherein return current flows from the diplexer via a single output connector to a transceiver.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

DETAILED DESCRIPTION OF THE INVENTION

Figure 1:
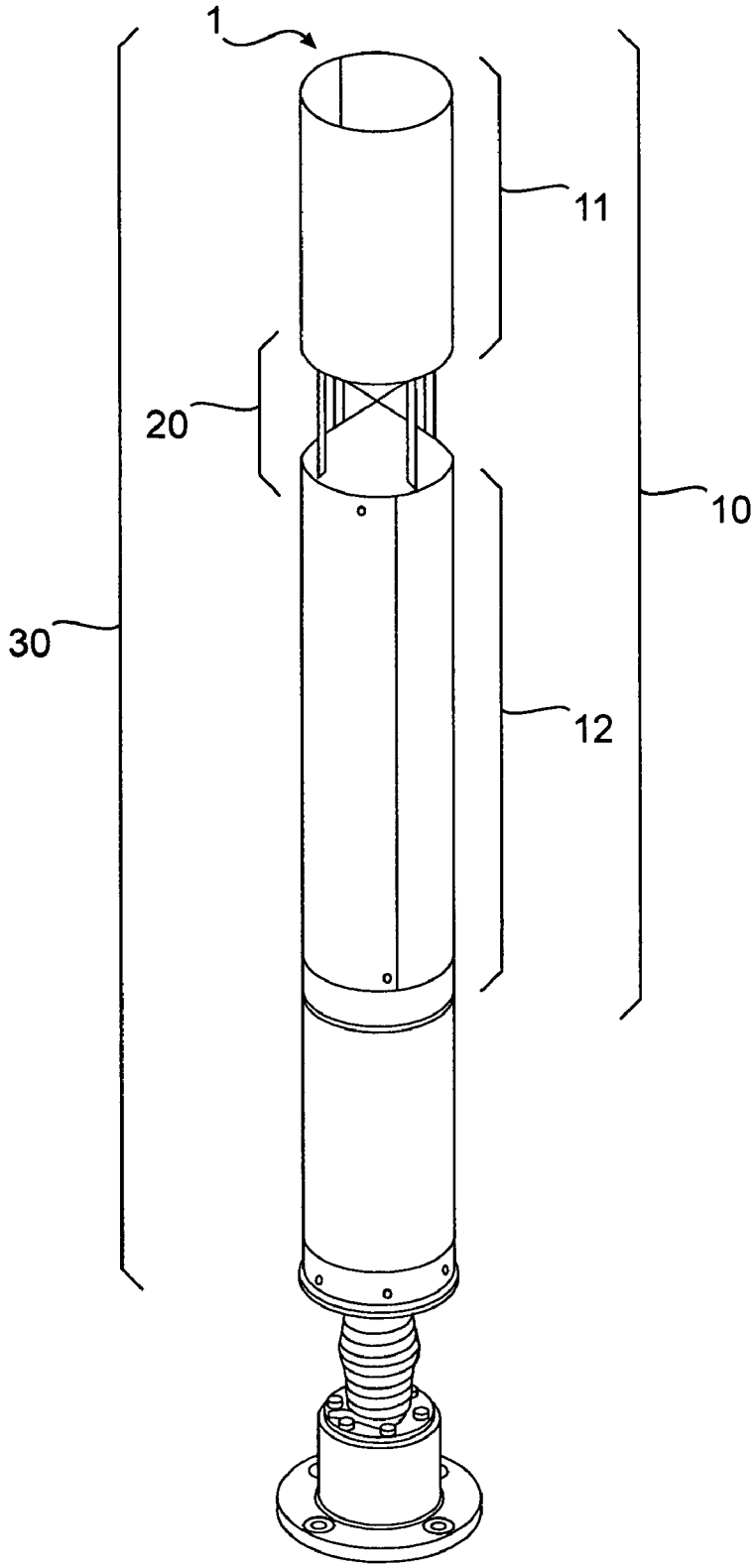
FIG. 1 is a perspective view diagramming the functionality of an ultra-broadband antenna system having an asymmetrical dipole element, a biconical dipole element and a monopole element according to a first embodiment of the present invention.

Referring now to FIG. 1, a preferred embodiment of the present invention is shown as ultra-broadband antenna system 1. Ultra-broadband antenna system 1 preferably comprises asymmetrical dipole element 10 and biconical dipole element 20, which together combine to form monopole element 30. Asymmetrical dipole element 10 further comprises upper asymmetrical dipole element 11 and lower asymmetrical dipole element 12. FIG. 1 diagrams the functionality of components of the ultra-broadband antenna system of the present invention.

Figure 2:
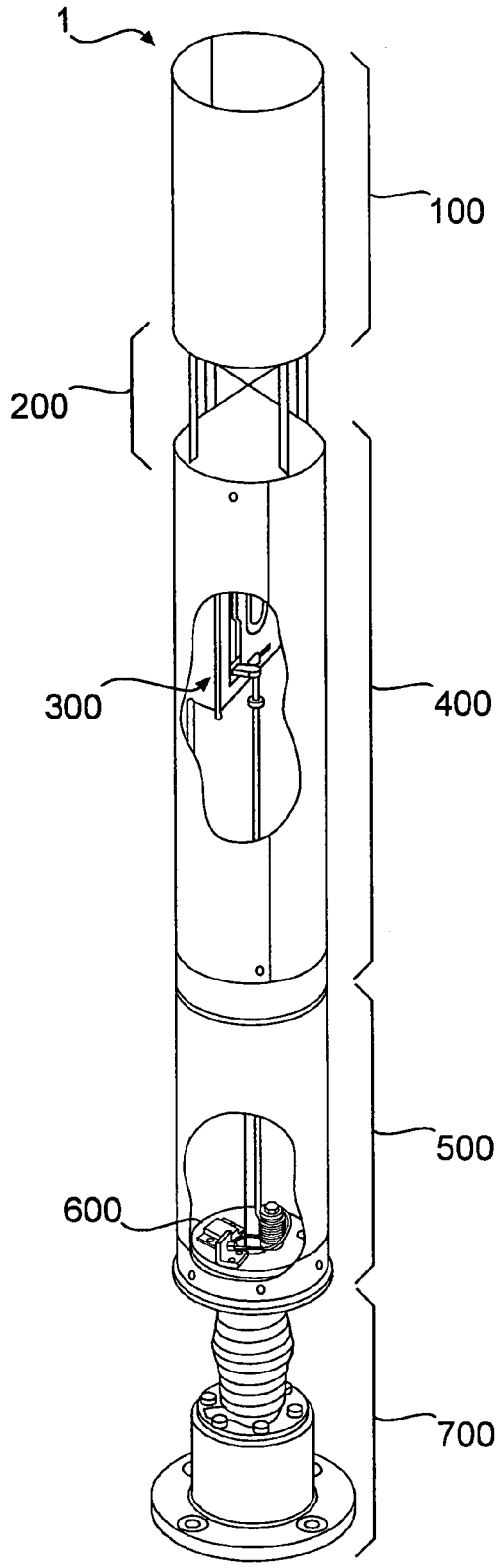
FIG. 2 is a perspective view of the sub-assemblies of an ultra-broadband antenna system according to a first embodiment of the present invention.

Referring now to FIG. 2 showing the major component sub-systems of the present invention, ultra-broadband antenna system 1 preferably comprises upper cylinder 100, cone/rod sub-assembly 200, balun sub-assembly 300, lower cylinder 400, canister sub-assembly 500, choke sub-assembly 600, and spring/base sub-assembly 700.

Figure 3:
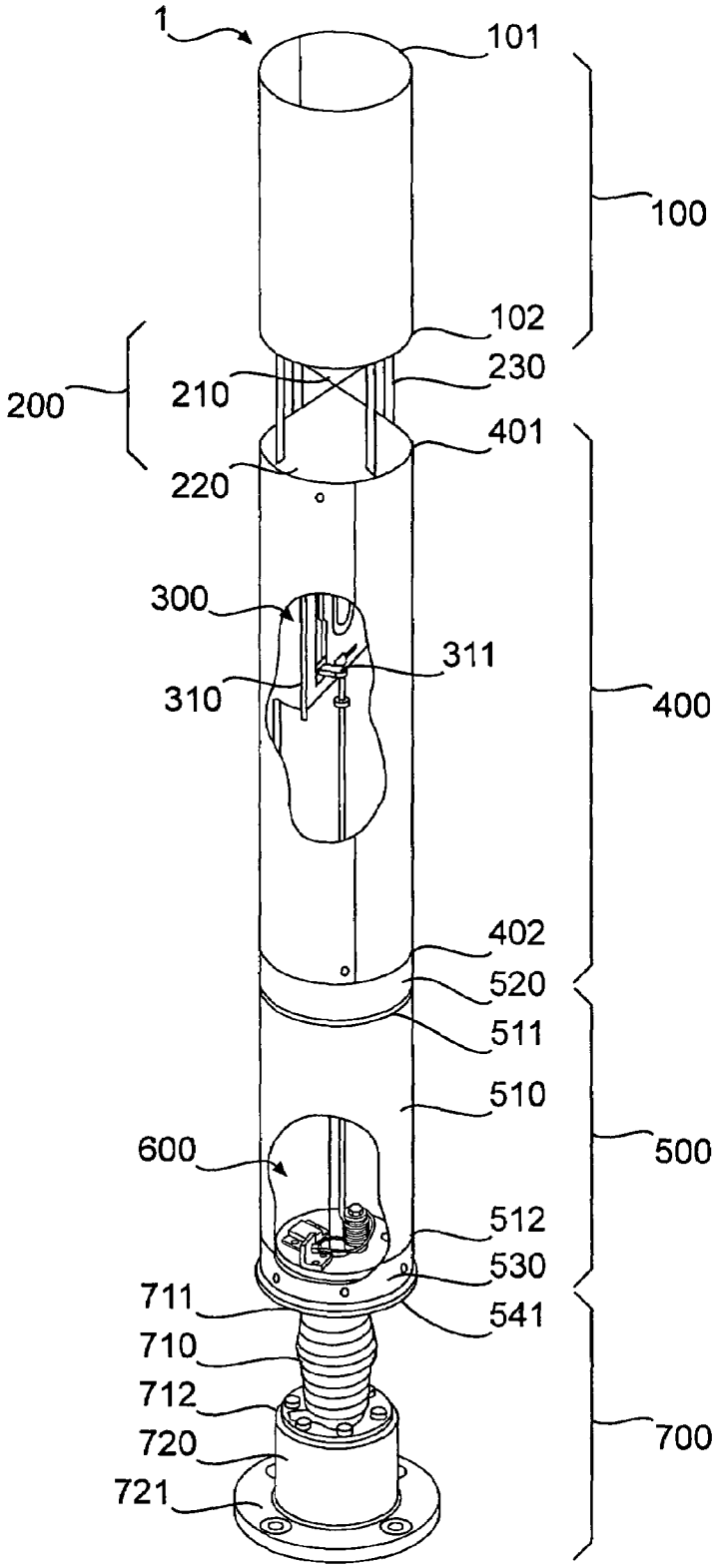
FIG. 3 is a perspective view of the sub-assemblies and elements of an ultra-broadband antenna system according to a first embodiment of the present invention.

Referring now to FIG. 3, the major component sub-systems of the present invention 1 preferably are connected to each other as follows. Upper cylinder 100 preferably comprises upper edge 101 and lower edge 102, and lower cylinder 400 preferably comprises upper edge 401 and lower edge 402. Upper cylinder 100 and lower cylinder 400 may be formed from any appropriate thin sheet metal, such as steel or aluminum, or from wires, grids or frequency-selective sheets, or from other conductive material that provides adequate support and rigidity. Upper cylinder 100 preferably is connected to cone/rod sub-assembly 200 at lower edge 102, and lower cylinder 400 preferably is connected to cone/rod sub-assembly 200 at upper edge 401.

With continuing reference to FIG. 3, cone/rod sub-assembly 200 preferably further comprises upper cone 210 and lower cone 220. Cone/rod sub-assembly 200 typically is provided with four spacer rods 230, however the number of spacer rods 230 may vary as desired for adequate support. Cone/rod sub-assembly 200 may be formed from any appropriate milled, cast, formed or stamped metal, such as aluminum, or from any other appropriate conductive material that provides adequate conductivity, support and rigidity. Spacer rods 230 may be formed from any appropriate insulating material such as epoxy fiberglass, plastic, polycarbonate, nylon or other material that provides adequate insulation, support and rigidity.

With continuing reference to FIG. 3, balun sub-assembly 300 preferably is provided inside of lower cylinder 400, below cone/rod sub-assembly 200. Balun sub-assembly 300 preferably further comprises balun board 310. Balun board 310 is preferably a printed circuit wiring board made from dielectric material, such as Teflon fiberglass ceramic board. Balun board preferably further comprises balun board connector 311, which serves to attach balun sub-assembly electrically to choke sub-assembly 600. Balun board connector 311 preferably is a miniature common RF connector such as SMA, SSMA, OSSM or SSMA connectors or any other suitable RF connector.

With continuing reference to FIG. 3, canister sub-assembly 500 preferably comprises canister tube 510, having upper edge 511 and lower edge 512. Canister tube 510 may be formed from any appropriate thin sheet metal, such as steel, aluminum, or other appropriate conductive material that provides adequate conductivity, support and rigidity. Canister sub-assembly 500 further comprises cylinder expander ring 520 and dielectric isolator 530. Cylinder expander ring 520 may be formed from any plastic, such as polycarbonate, or other material that provides adequate insulation, support and rigidity. Dielectric isolator 530 also may be formed from any plastic, such as polycarbonate, or other material that provides adequate insulation, support and rigidity. Cylinder expander ring 520 preferably is attached to canister tube upper edge 511. Dielectric isolator 530 preferably is attached to canister tube lower edge 512, and is supported on flange 541. Canister sub-assembly 500 and lower cylinder 400 preferably are connected at cylinder expander ring 520 and lower cylinder lower edge 402.

With continuing reference to FIG. 3, choke sub-assembly 600 is provided inside of canister sub-assembly 500.

With continuing reference to FIG. 3, spring/base sub-assembly 700 preferably further comprises spring 710, spring base 720 and base flange 721. Spring 710 preferably is formed from metal, such as steel or aluminum, and serves as a conductor for ultra-broadband antenna system 1. Spring 710 preferably provides a conductive path for the ground return currents of monopole 30. Spring 710 may be any commercially available spring that is conductive and is adequately strong to support ultra-broadband antenna system 1. Spring 710 preferably further comprises top plate 711 (not visible under base flange 541) and bottom plate 712, which serve to attach spring 710 to base flange 541 and spring base 720, respectively. Spring 710 allows the tubular.structure of ultra-broadband antenna system 1 to flex back and forth in the case of impact with an obstruction, thus reducing the chance of damage to the antenna. Base flange 721 preferably serves to attach ultra-broadband antenna system 1 to a substrate, such as a vehicle, building, aircraft, ship or other surface. Spring base 720 may be formed from any appropriate milled, cast, formed or stamped conductive metal, such as aluminum, or other material that provides adequate conductivity, support and rigidity.

Figure 4:
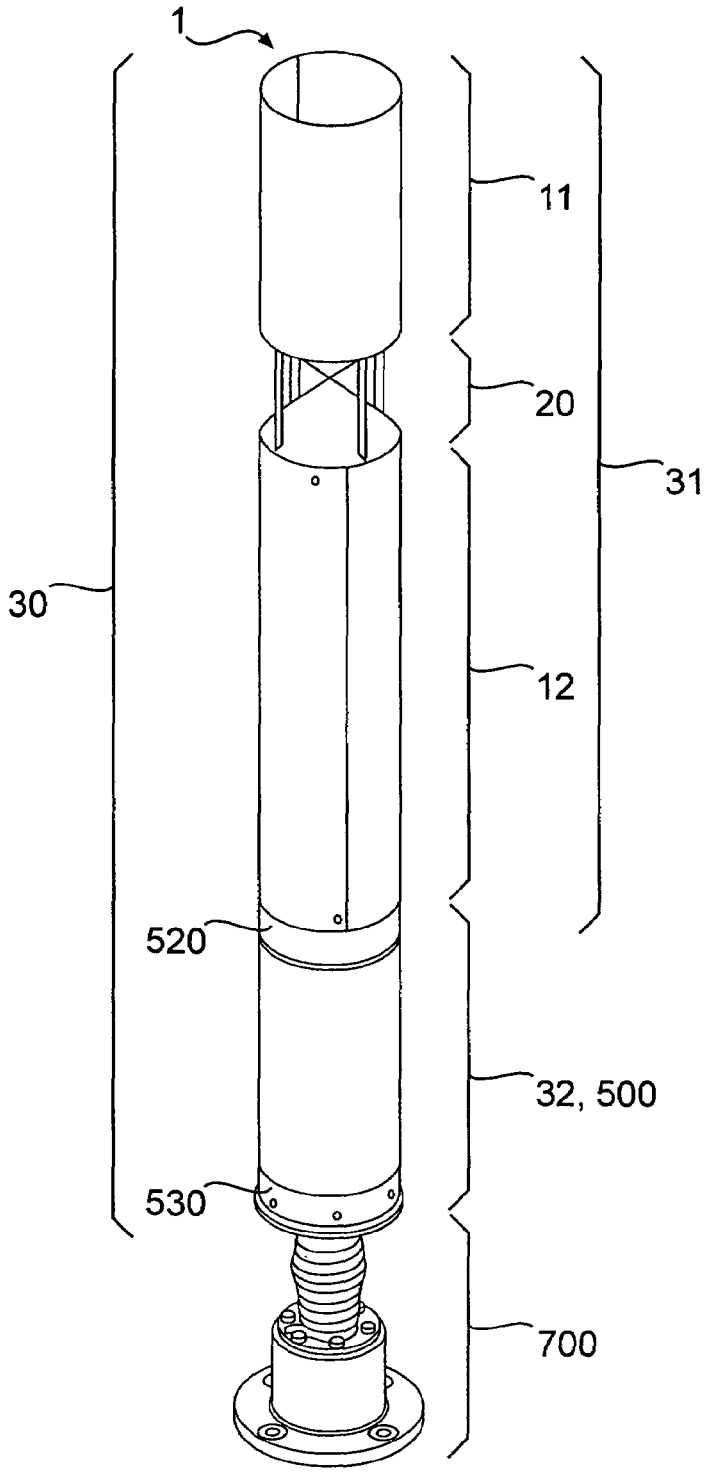
FIG. 4 is a perspective view of the monopole element and its relationship to the other elements of an ultra-broadband antenna system according to a first embodiment of the present invention.

Referring now to FIG. 4, a perspective view of ultra-broadband antenna system 1 is shown, wherein monopole element 30 preferably further comprises upper monopole section 31 and lower monopole section 32. Upper monopole section 31 preferably corresponds to the combination of upper asymmetrical dipole element 11, biconical dipole element 20, and lower asymmetrical dipole element 12. Lower monopole section 32 preferably corresponds to canister sub-assembly 500. Cylinder expander ring 520 preferably is an insulating ring that separates upper asymmetrical dipole element 11, biconical dipole element 20, and lower asymmetrical dipole element 12 from lower monopole section 32. Dielectric isolator 530 isolates spring/base sub-assembly 700 from canister sub-assembly 500, thus isolating entire monopole 30 so that monopole sections 31 and 32 form one contiguous monopole conductor from the ground potential. Spring/base sub-assembly 700 preferably comprises a part of the ground side of monopole 30.

Figure 5:
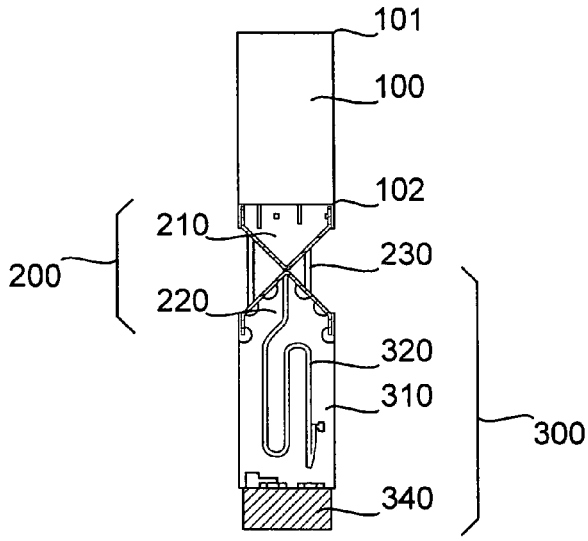
FIG. 5 is a sectional side view of the upper cylinder, cone/rod sub-assembly and balun sub-assembly of an ultra-broadband antenna system according to a first embodiment of the present invention.

Referring now to FIG. 5, a sectional side view of upper cylinder 100, cone/rod sub-assembly 200 and balun sub-assembly 300 with balun board 310 is shown. Upper cone 210, lower cone 220, and spacer rod 230 of cone/rod sub-assembly 200 are shown. Upper edge 101 and lower edge 102 of asymmetrical dipole upper cylinder 100 are shown. Balun board 310 preferably further comprises balun feed side/connector center conductor side trace 320 on one side. Balun feed side/connector center conductor side trace 320 is a conductor and preferably is applied to balun board 310 via a photolithography etching process. Balun feed side/connector center conductor side trace 320 preferably feeds lower cone 220. Balun sub-assembly 300 is supported in asymmetrical dipole lower cylinder 400 by foam support 340. Foam support 340 may be formed from Styrofoam, polystyrene foam, polyurethane foam or other structural foams.

Figure 6A:
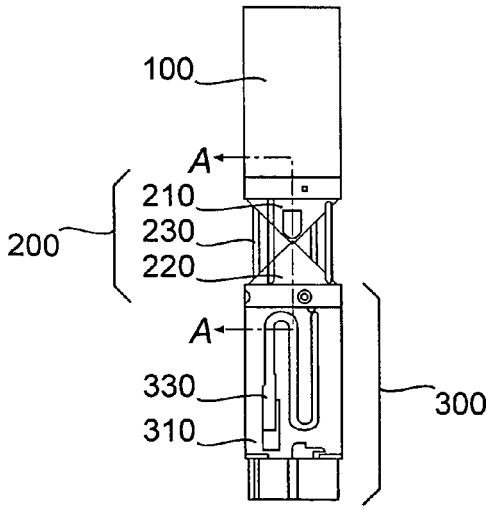
FIG. 6*a* is a sectional side view of the upper cylinder, cone/rod sub-assembly and balun sub-assembly of an ultra-broadband antenna system according to a first embodiment of the present invention.

Referring now to FIG. 6*a*, a second sectional side view of upper cylinder 100, cone/rod sub-assembly 200 and balun sub-assembly 300 shows the opposite side of balun sub-assembly 300, wherein balun board 310 preferably further comprises balun ground side/connector body side trace 330. Balun ground side/connector body side trace 330 is a conductor and preferably is applied to balun board 310 via a photolithography etching process. Balun ground side/connector body side trace 330 preferably feeds upper cone 210. Four spacer rods 230 are shown around upper cone 210 and lower cone 220.

Figure 6B:
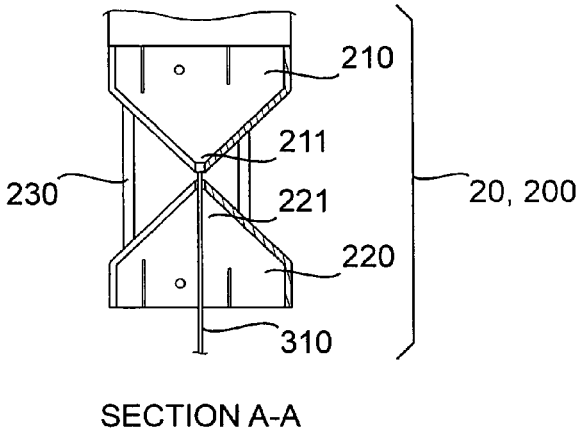
FIG. 6*b* is an expanded sectional view of the cone/rod sub-assembly of FIG. 6*a* of an ultra-broadband antenna system according to a first embodiment of the present invention.

Referring now to FIG. 6*b*, an expanded cross-sectional view of cone/rod sub-assembly 200, upper cone 210 and lower cone 220 is shown rotated 90° from the view in FIG. 6*a*. Balun board 310 is shown in cross-section. Upper cone 210 preferably further comprises upper conic tip 211, and lower cone 220 preferably further comprises lower conic tip 221. The shape of conic tips 211 and 221 is integral to the desired performance of the preferred embodiment of biconical dipole element 20. As shown also in FIG. 7*a* below, the upper cone 210 and lower cone 220 are collinear, and absent the disclosed truncation of conic tips 211 and 221, cones 210 and 220 would touch at a single point, affecting antenna performance. A finite gap (describe further in FIG. 7*b*) is required to maintain positive and negative currents and electric fields on upper cone 210 and lower cone 220. As the size of the tip is reduced, the antenna will operate at higher frequencies. Thus, a small finite gap is desirable in order to achieve high frequency performance. A gap of 1 mm to 4 mm is a typical and preferred embodiment.

Figure 7A:
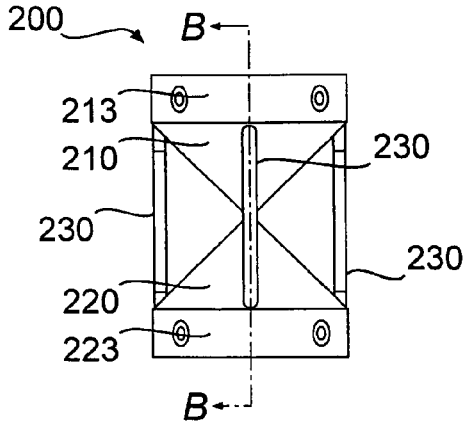
FIG. 7*a* is a side view of the cone/rod sub-assembly of an ultra-broadband antenna system according to a first embodiment of the present invention.

Referring now to FIG. 7*a*, a side view of cone/rod sub-assembly 200 is shown. Cone/rod sub-assembly 200 preferably further comprises upper attachment band 213, which provides a surface of attachment for upper cone 210 to upper cylinder 100, and lower attachment band 223, which provides a surface of attachment for lower cone 220 to lower cylinder 400. Upper attachment band 213 is oriented substantially parallel to the curved surface of upper cylinder 100, and is formed from the same milled, cast, formed or stamped piece of metal, such as aluminum, or any other appropriate conductive material, as upper cone 210. Lower attachment band 223 similarly is oriented substantially parallel to the curved surface of lower cylinder 400, and is formed from the same milled, cast, formed or stamped piece of metal, such as aluminum, any other appropriate conductive material, as lower cone 220.

Figure 7B:
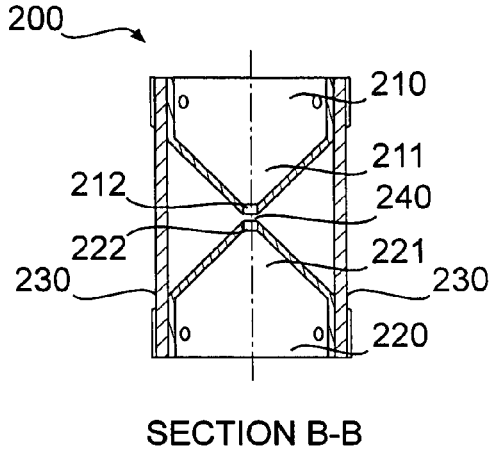
FIG. 7*b* is a sectional side view of FIG. 7*a*, showing the cone/rod sub-assembly of an ultra-broadband antenna system according to a first embodiment of the present invention.

Referring now to FIG. 7*b*, a sectional side view is shown of the cone/rod sub-assembly 200 of FIG. 7*a*. Cone/rod sub-assembly 200 preferably further comprises gap 240 between upper conic tip 211 and lower conic tip 221. Spacer rods 230 serve to hold upper cone 210 and lower cone 220 precisely in place so that in the preferred embodiment, gap 240 is maintained between approximately 1 mm and 4 mm. Gap 240 may, however, be any width that achieves adequate antenna performance for the functionality desired. As shown in FIG. 7*b*, upper cone 210 preferably further comprises upper conic tip hole 212, in the center of upper conic tip 211, and lower cone 220 preferably further comprises lower conic tip hole 222, in the center of lower conic tip 221.

Figure 8:
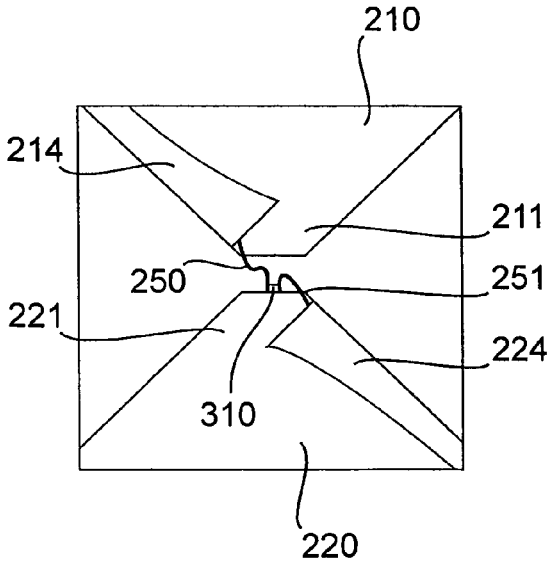
FIG. 8 is a enlarged side view of the conic tips and feed braids of the biconical dipole element of an ultra-broadband antenna system according to a first embodiment of the present invention.

Referring now to FIG. 8, an enlarged side view of upper conic tip 211 and lower conic tip 221 is shown. Cone/rod sub-assembly 200 preferably further comprises upper cone feed braid 250, lower cone feed braid 251, upper cone tape 214 and lower cone tape 224. Upper cone feed braid 250 and lower cone feed braid 251, are substantially the same and are interchangeable in that either feed braid (250 or 251) may be connected initially to either cone (210 or 220). The configuration as shown will now be described, referring additionally to FIGS. 6*a* and 7*b*: upper cone feed braid 250 preferably is soldered to balun ground side/connector body side trace 330 and is fed from balun ground side/connector body side trace 330 through lower conic tip hole 222, extending to upper conic tip 211. Upper cone feed braid 250 is an electrically hot conductor and does not touch lower cone 220. Upper cone feed braid 250 preferably is formed into an approximate "S" curve in order to provide strain relief, and is then attached to the outside surface of upper cone 210 via upper cone tape 214. Upper cone tape 214 preferably is an adhesive-backed aluminum tape, however, upper cone feed braid 250 may be attached via another conductive adhesive material or screwed onto upper cone 210 via a conductive screw (not shown).

With continuing reference to FIG. 8, along with FIGS. 5 and 7*b*, lower cone feed braid 251 preferably is soldered to balun feed side/connector center conductor side trace 320 and is fed from balun feed side/connector center conductor side trace 320 through lower conic tip hole 222, extending out of lower conic tip 221. Lower cone feed braid 251 is also an electrically hot conductor and does not touch upper cone 210. Lower cone feed braid 251 preferably is formed into an approximate "upside down U" curve in order to provide strain relief, and is then attached to the outside surface of lower cone 220 via lower cone tape 224. Lower cone tape 224 preferably is an adhesive-backed aluminum tape, however, lower cone feed braid 251 may be attached via another conductive adhesive material or screwed onto lower cone 220 via a conductive screw (not shown). As shown in FIG. 8, the tip of balun board 310 protrudes slightly from lower conic tip hole 222 (shown only in FIG. 7*b*, a cross section of cone/rod sub-assembly 200) and supports both balun traces 320 and 330. In summary, one feed braid, connected to one balun trace, is electrically attached to one cone (as shown, upper cone feed braid 250 attaches to balun ground side/connector body side trace 330 and then to upper cone 210). The other feed braid, connected to the other balun trace, is electrically attached to the other cone (as shown, lower cone feed 251 attaches to balun feed side/connector center conductor side trace 320 and then to lower cone 210). This configuration may be switched between the upper and lower cones if desired. Slack is provided in the configuration of upper cone feed braid 250 and lower cone feed braid 251 in order to provide strain relief and reduce risk of breakage. Further, both upper cone feed braid 250 and lower cone feed braid 251 preferably comprise a multiplicity of individual wires braided together. The multiplicity of wires enhances reliability of the antenna because if one wire should break, the remaining wires still function to conduct.

Figure 9:
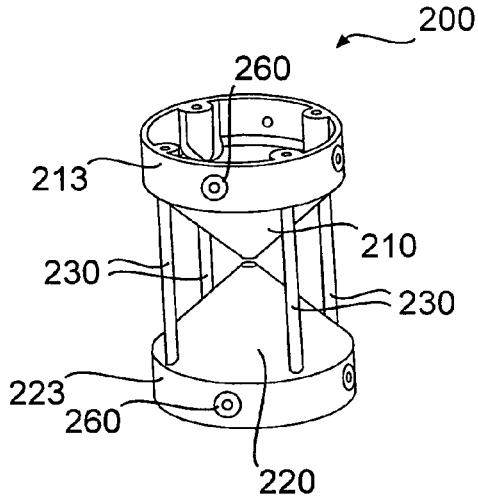
FIG. 9 is a perspective view of the cone/rod sub-assembly of an ultra-broadband antenna system according to a first embodiment of the present invention.

Referring now to FIG. 9, a perspective view of cone/rod sub-assembly 200 is shown, comprising upper cone 210 and upper attachment band 213, lower cone 220 and lower attachment band 223, and spacer rods 230. Cone/rod sub-assembly 200 preferably further comprises a plurality of attachment holes 260 in upper attachment band 213 and lower attachment band 223. Upper cylinder 100 and lower cylinder 400 are attached, respectively, to upper cone 210 and lower cone 220 via screws or other appropriate fasteners inserted into attachment holes 260.

Figure 10:
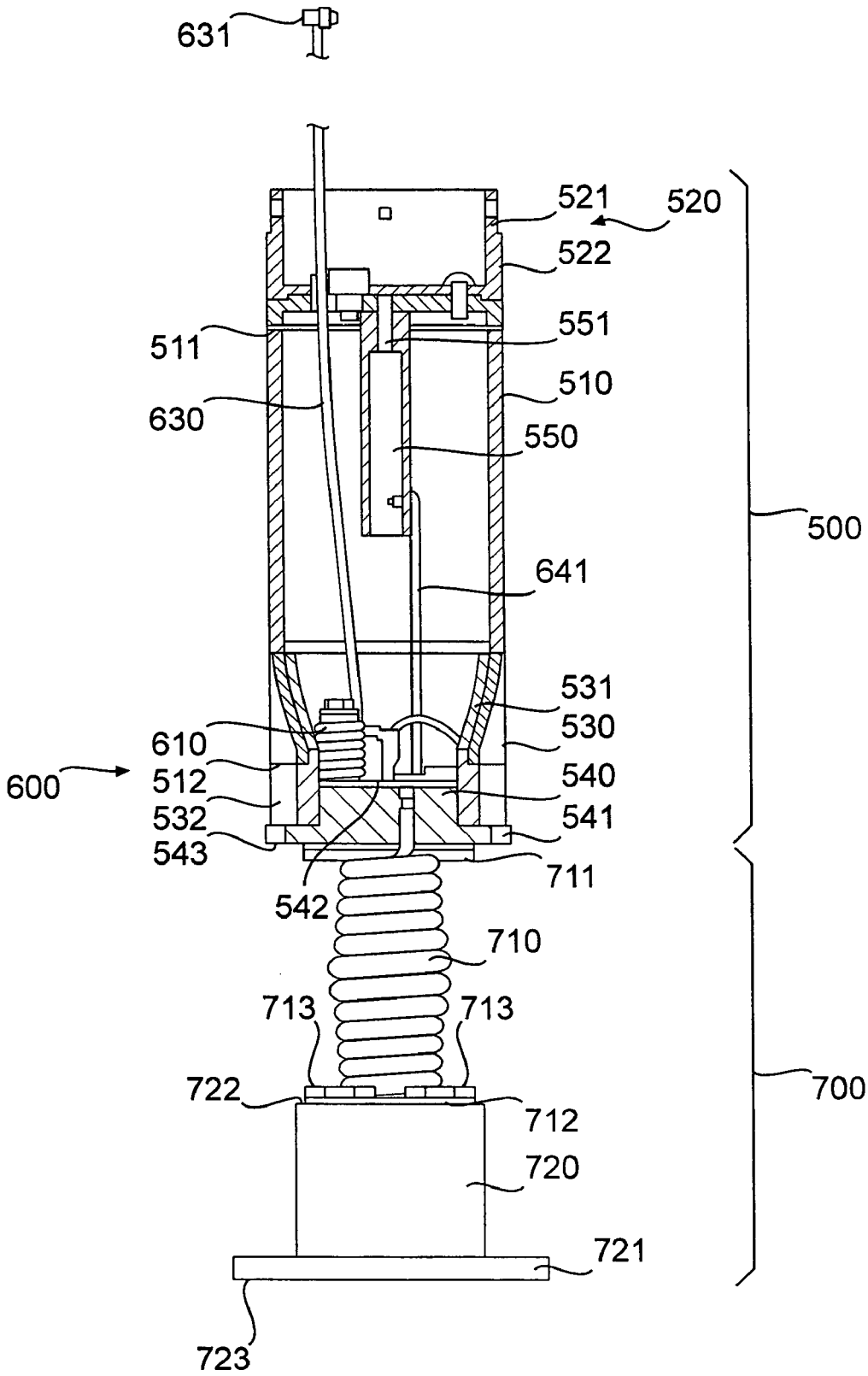
FIG. 10 is a sectional side view of the canister sub-assembly, choke sub-assembly and spring/base sub-assembly of an ultra-broadband antenna system according to a first embodiment of the present invention.

Referring now to FIG. 10, a cross-section of canister sub-assembly 500, canister tube 510, and spring/base sub-assembly 700 is shown. Cylinder expander ring 520 is shown, and preferably further comprises upper section 521, having a reduced diameter, and lower section 522, having a diameter substantially the same as lower cylinder 400. Cylinder expander ring 520 is preferably attached to canister tube 510 at upper edge 511. Referring additionally to FIG. 3, lower cylinder 400, at lower edge 402, fits over and is attached to reduced-diameter upper section 521 of cylinder expander ring 520, so that the surface of ultra-broadband antenna system 1 is flush and continuous along lower cylinder 400, cylinder expander ring 520 and canister tube 510. Dielectric isolator 530 is shown, and preferably further comprises upper section 531, having a reduced diameter, and lower section 532, having a diameter substantially the same as canister tube 510. Canister tube 510, at lower edge 512, fits over and is attached to reduced-diameter upper section 531 of dielectric isolator 530, so that the surface of ultra-broadband antenna system 1 is flush and continuous along lower cylinder 400, canister tube 510 and dielectric isolator 530.

With continuing reference to FIG. 10, canister sub-assembly 500 preferably further comprises base hub 540, having top surface 542 and bottom surface 543. Base hub 540 preferably further comprises flange 541. Base hub 540 and flange 541 may be formed from any appropriate milled, cast, formed or stamped conductive metal, such as aluminum, or other material that provides adequate conductivity, support and rigidity. Base hub 540 preferably provides a support and point of attachment for choke sub-assembly 600, while flange 541 preferably provides a support and point of attachment for dielectric isolator 530. Canister sub-assembly 500 preferably further comprises low-band feed tapped hole 550, centrally located in canister tube 510.

With continuing reference to FIG. 10 and additionally to FIG. 1, choke sub-assembly 600 further comprises ferrite choke 610, high-band coaxial cable 630, coaxial connector 631 and low-band wire 641. Ferrite choke is encircled with high-band coaxial cable 630, which feeds asymmetrical dipole element 10 and biconical dipole element 20. By providing several turns of high-band coaxial cable 630 around ferrite choke 610, high-band coaxial cable 630 appears as a large inductor with high impedance. This prevents the low band antenna (monopole element 30) from being shorted by high band coaxial cable 630. The combination of high band coaxial cable 630 plus ferrite choke 610 then appears as a reactance that is substantially an open circuit to the lower frequencies, thus enabling the combination of asymmetrical dipole element 10 and biconical dipole element 20 to function as monopole 30. With additional reference to FIG. 3, coaxial connector 631 preferably connects high-band coaxial cable 630 to balun board connector 311 and thus to balun board 310. Coaxial connector 631 preferably is a miniature common RF connector such as an SMA, SSMA, OSSM or SSMA connector or any other suitable RF connector. Ferrite choke 610 and high-band coaxial cable 630 may be supplied from commercially available materials. Low-band wire 641 preferably is screwed into low-band feed tapped hole 550 via tapped hole screw 551 and thus is connected to canister tube 510. Thereby, low-band wire 641 feeds monopole 30.

With continuing reference to FIG. 10, spring/base sub-assembly 700, spring 710, having top plate 711 and bottom plate 712, spring base 720 and base flange 721 are shown. At its upper end, spring base 720 preferably further comprises top surface 722, while bottom surface 723 is preferably located at lower end of spring base 720. Spring/base sub-assembly 700 further comprises a plurality of bolts 713, which serve to attach spring 710, via bottom plate 712, to top surface 722 of spring base 720. Bolts 713 may be steel or any other metal that provides adequate support, rigidity and an adequate conductive path for the return currents of monopole 30.

Figure 11:
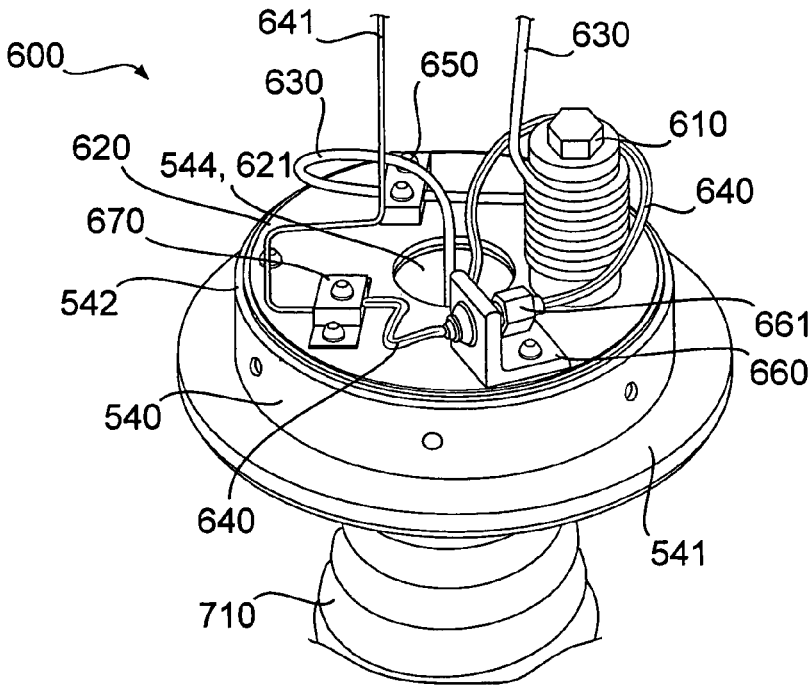
FIG. 11 is a perspective view of the choke sub-assembly and base hub of an ultra-broadband antenna system according to a first embodiment of the present invention.

Referring now to FIG. 11, a perspective view of choke sub-assembly 600 is shown. Ferrite choke 610, high-band coaxial cable 630 and low-band wire 641, as described above with reference to FIG. 10, are shown. Base hub 540 and top surface 542, flange 541 and spring 710, as described above with reference to FIG. 10, are also shown. Base hub 540 preferably further comprises hub aperture 544, located in the center of base hub 540 and extending from top surface 542 all the way through base hub 540 to bottom surface 543 (not shown in this view). Choke sub-assembly 600 preferably further comprises low-band coaxial cable 640.

With continuing reference to FIG. 11, choke sub-assembly 600 preferably further comprises printed wiring board 620, a thin disk, of substantially the same diameter as base hub 540, which is placed on top surface 542 of base hub 540. Printed wiring board 620 preferably is formed from a thin sheet of dielectric material and further comprises circuitry etched thereon. The circuitry on printed wiring board 620 functions to route the connection from low-band coaxial cable 640 to a low-band resistive pad, attenuator 670. Attenuator 670 serves to reduce the reflections from the low-band antenna (monopole element 30) and lower the VSWR of the ultra-broadband antenna system as embodied herein. Printed wiring board 620 preferably further comprises PWB aperture 621, located in the center of printed wiring board 620.

With continuing reference to FIG. 11, low-band coaxial cable 640 preferably is routed into area of choke sub-assembly 600 through hub aperture 544 and PWB aperture 621. Low-band coaxial cable 640 preferably passes around ferrite choke 610 and is isolated from high-band coaxial cable 630 to prevent shorting. Both low-band coaxial cable 640 and high-band coaxial cable 630 are covered with an outer plastic (non-conductive) jacket. Low-band coaxial cable 640 preferably continues into SMA connector 661, which is supported by L bracket 660. Passing out of SMA connector 661, the center wire of low-band coaxial cable 640 preferably continues as low-band wire 641, and further passes through attenuator 670. Attenuator 670 may be selected from commercially-available stock such as that formed from lossy RF material, including carbon-loaded film. Attenuator 670 is preferably 2 dB but may range from approximately 1 to 3 dB. In addition to reducing the VSWR of monopole element 30, attenuator 670 additionally matches impedance to the receiver, and therefore makes the signal more acceptable to the transponder used with ultra-broadband antenna system 1. Low-band wire 641 preferably continues up into canister sub-assembly 500, as described above in reference to FIG. 10, and feeds monopole element 30.

With continuing reference to FIG. 11, high-band coaxial cable 630 preferably is routed into area of choke sub-assembly 600 through hub aperture 544 and PWB aperture 621. High-band coaxial cable 630 preferably passes through ground clamp 650, which serves to ground outer jacket of high-band coaxial cable 630 to base hub 540 and spring/base sub-assembly 700. In addition, ground clamp 650 provides support for high-band coaxial cable 630 so that it is not dislodged or detached. Thereafter, high-band coaxial cable 630 preferably is coiled around ferrite choke 610 for 8 to 12 turns and continues up into canister sub-assembly 500, and, as described above in reference to FIG. 10, is connected to balun sub-assembly 300, whereby it feeds asymmetrical dipole element 10 and biconical dipole element 20.

Figure 12:
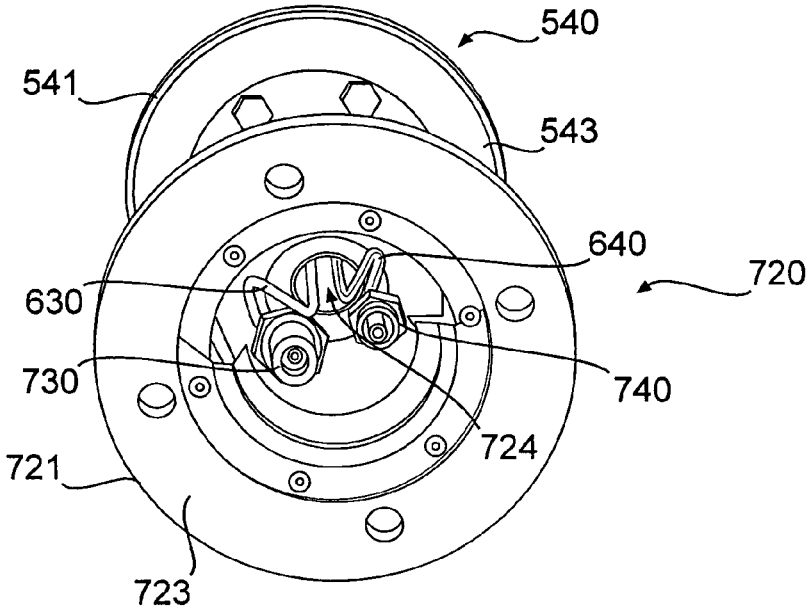
FIG. 12 is a perspective view of the underside of the spring base of an ultra-broadband antenna system according to a first embodiment of the present invention.

Referring now to FIG. 12, a perspective view of the underside of spring base 720, including base flange 721, is shown. A portion of the underside of base hub 540, including base hub bottom surface 543 and flange 541, as described above with reference to FIG. 10, is also shown. Spring base 720 preferably further comprises base aperture 724, located in the center of top surface 722 (not visible in this view). High-band coaxial cable 630 and low-band coaxial cable 640 preferably are routed into area of spring base 720 through base aperture 724. In a preferred embodiment of ultra-broadband antenna system 1, high-band coaxial cable 630 is connected to high-band N connector 730, and thereafter to a transceiver. Similarly, low-band coaxial cable 640 preferably is connected to low-band BNC connector 740, and thereafter to a transceiver.

Figure 13:
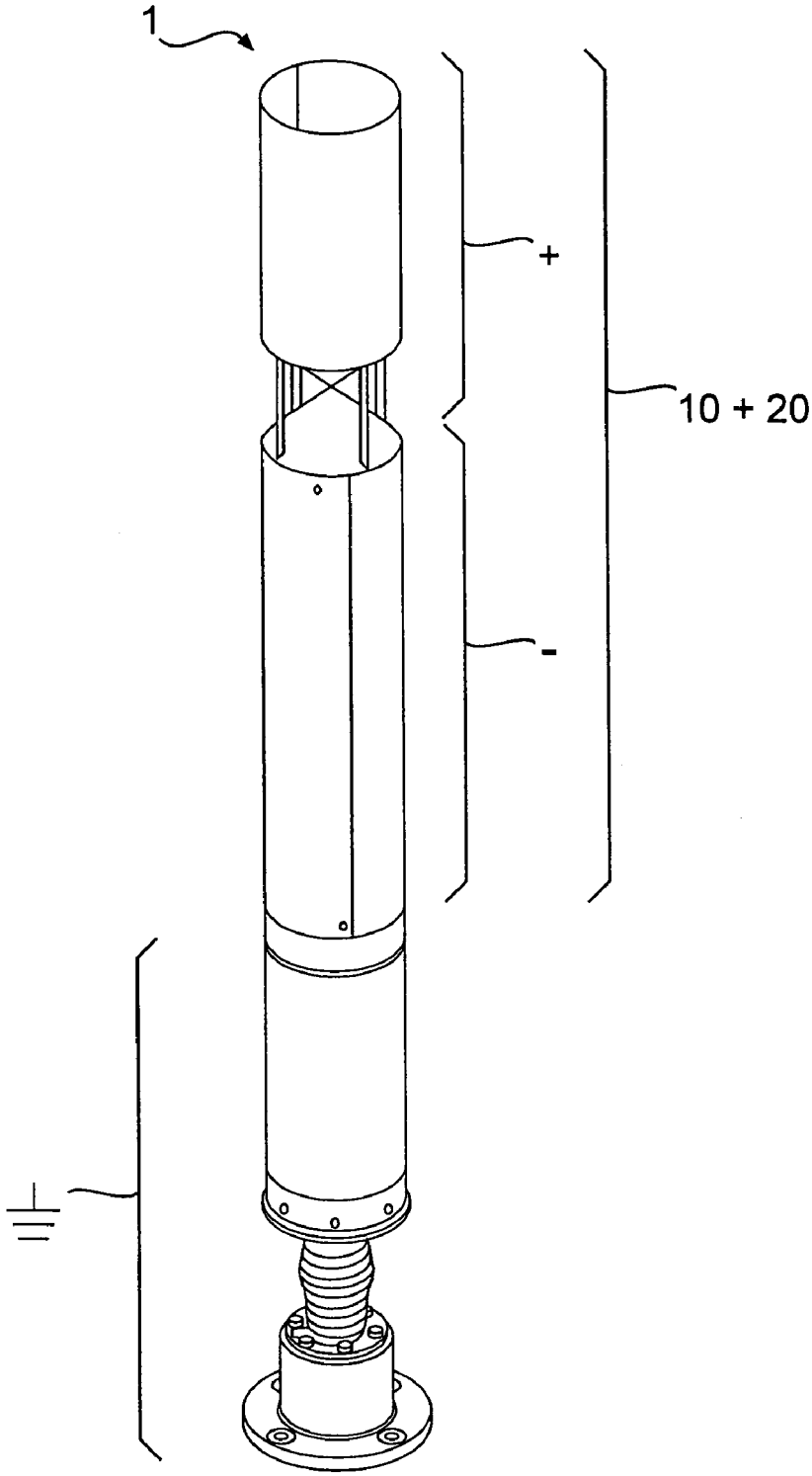
FIG. 13 is a perspective view diagramming the electrical activity of the dipole elements of an ultra-broadband antenna system according to a first embodiment of the present invention.

Referring now to FIG. 13, a perspective view of ultra-broadband antenna system 1 is shown diagramming electrical activity in the high-band range for asymmetrical dipole element 10 and biconical dipole element 20. The upper portions of the asymmetrical dipole and the biconical dipole are fed at one potential (positive) and the lower portions of the asymmetrical and the dipole biconical dipole are fed at the opposite potential (negative). This sets up preferred currents and electric field, enabling the ultra-broadband antenna system to operate over an extended bandwidth. The asymmetrical dipole arrangement is advantageous because it prevents formation of a pattern null perpendicular to the axis of the ultra-broadband antenna system when the overall height of the system approaches one wavelength. The biconical dipole provides a transition for the impedance of the combined asymmetrical and biconical dipoles to the feed. The floating ground does not interact with the dipole function of the ultra-broadband antenna system as embodied herein.

Figure 14:
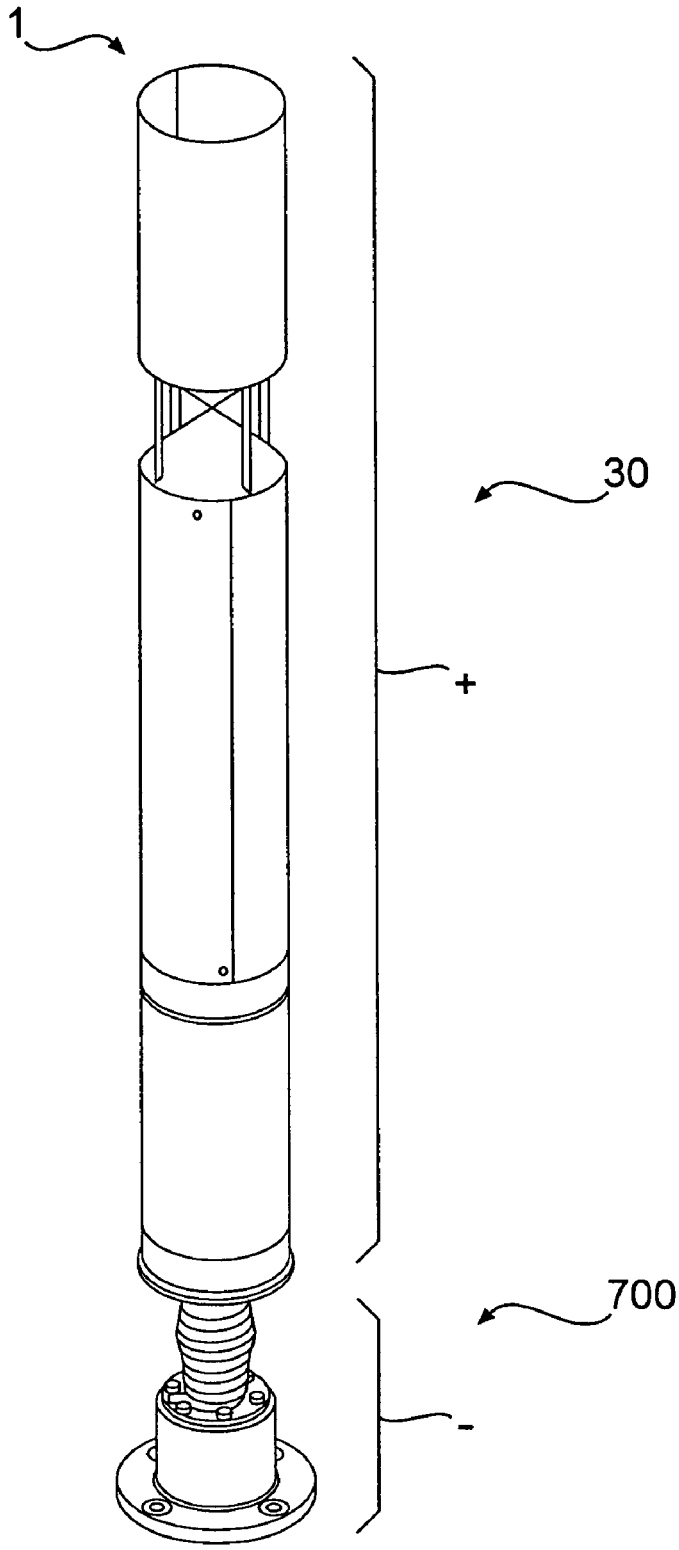
FIG. 14 is a perspective view diagramming the electrical activity of the monopole element of an ultra-broadband antenna system according to a first embodiment of the present invention.

Referring now to FIG. 14, a perspective view of ultra-broadband antenna system 1 is shown diagramming the electrical activity in the low-band range for monopole element 30. Both sections of monopole 30 (upper monopole section 31 and lower monopole section 32 as shown in FIG. 4) are at the same potential. Monopole 30 is fed against spring/base sub-assembly 700 and the ground plane. The ground plane comprises and is defined as the vehicle or other substrate to which the antenna system is attached. An advantage of the disclosed configuration is that the entire length of the ultra-broadband antenna system is used to form monopole 30, thus taking maximum advantage of the combined height of all the sub-components. The height of canister sub-assembly 500/lower monopole section 32 (as shown in FIG. 4) preferably is used to adjust the frequency of the antenna system and in particular, the low end frequency of operation of the antenna system. This is an important feature of the present invention because adjusting the height of canister 500 does not affect the operation of the high frequency components (asymmetrical dipole element 10 and biconical dipole element 20, as shown in FIG. 1), yet it allows for an independent adjustment of the frequency of operation of the low band components (monopole 30)

Figure 15:
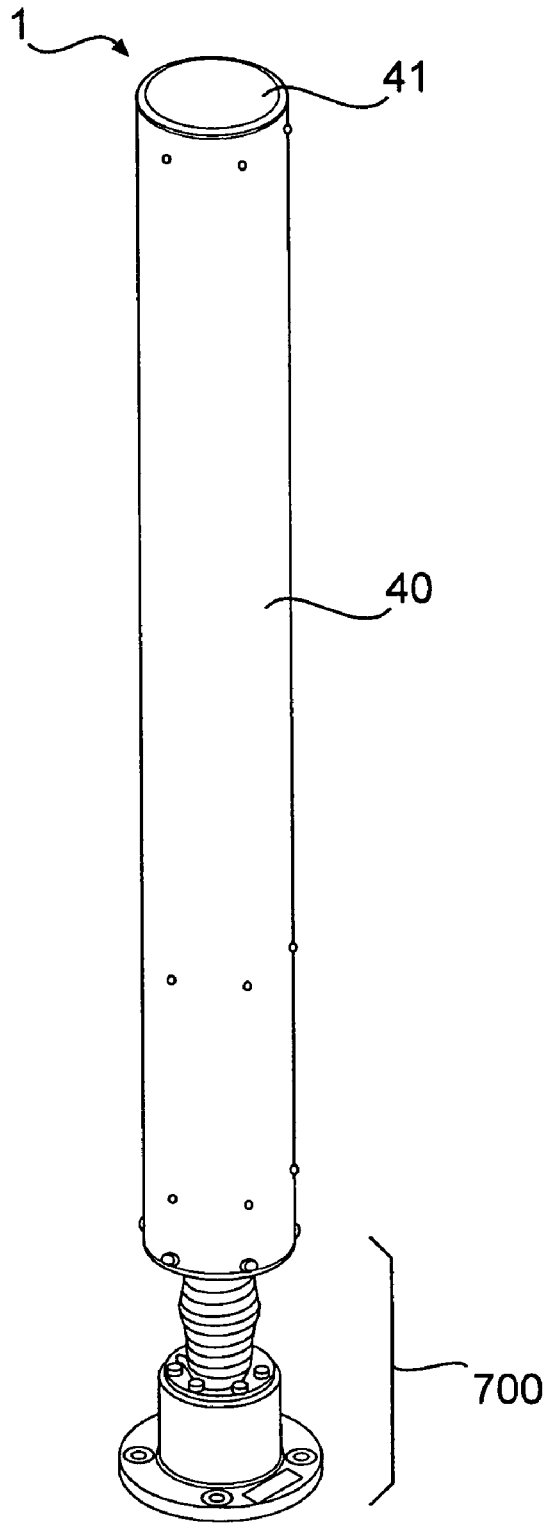
FIG. 15 is a perspective view of the fully-assembled ultra-broadband antenna system with radome according to a first embodiment of the present invention.

Referring now to FIG. 15, a perspective view of ultra-broadband antenna system 1 is shown, wherein ultra-broadband antenna system 1 further comprises radome 40 and end cap 41. Radome 40 and end cap 41 may be formed from a thin sheet of plastic that provides adequate mechanical support and allows for transmission of RF energy through radome 40. Typical materials include, but are not limited to, ABS plastic and fiberglass-impregnated epoxy. The present invention also contemplates the incorporation of a frequency selective surface into radome 40 that would allow passing of the antenna low and high frequencies (20 to 10,000 MHz) yet act as a conductive surface at higher frequencies.

Figure 16:
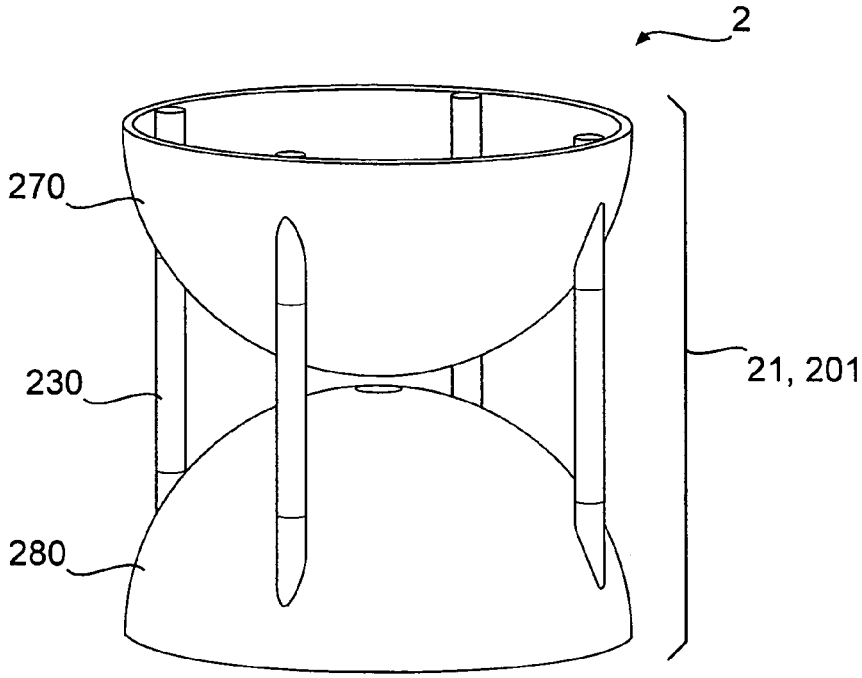
FIG. 16 is a perspective view of the hemisphere/rod sub-assembly of the biconical dipole element of an ultra-broadband antenna system according to a second embodiment of the present invention.

Referring now to FIG. 16, a first alternate embodiment of the present invention, ultra-broadband antenna system 2 is shown (in part), wherein alternate biconical dipole element 21 preferably comprises hemisphere/rod sub-assembly 201, an alternate configuration of biconical dipole element 20 and cone/rod sub-assembly 200 as disclosed in the preferred embodiment. Hemisphere/rod sub-assembly 201 preferably further comprises upper hemisphere 270, lower hemisphere 280, and a multiplicity of spacer rods 230. As embodied herein, the two hemispheres provide a gradual transition from the apex of the biconical dipole element 21 (the point of tangency between the two hemispheres) similar to the two cones of biconical dipole element 20. Also similar to biconical dipole antenna 20 of the preferred embodiment, the center of the two hemispheres may be opened out to prevent upper hemisphere 270 and lower hemisphere 280 from having contact, thus allowing setup of positive and negative electric fields. An advantage of the hemispherical shape over the conical shape is that the transition is more gradual. This preferably provides a better transition and better impedance match for dipole antenna element 21. The tangency of upper hemisphere 270 and lower hemisphere 280 and the more gradual transition of the curved surfaces may, however, make it necessary to adjust and control a tighter tolerance at the gap between the two hemispheres. Hemisphere/rod sub-assembly 201 typically is provided with four spacer rods 230, however the number of spacer rods 230 may vary as desired for adequate support of upper hemisphere 270 and lower hemisphere 280. Hemisphere/rod sub-assembly 201 may be formed from any appropriate milled, cast, formed or stamped metal, such as aluminum, or from any other appropriate conductive material that provides adequate conductivity, support and rigidity. Spacer rods 230 may be formed from any appropriate insulating material such as epoxy fiberglass, plastic, polycarbonate, nylon or other material that provides adequate insulation, support and rigidity. Hemispheres 270 and 280 comprise only one example of many possible variations of monotonically increasing or decreasing shapes for biconical dipole structures as contemplated by the present invention. It is contemplated by the present invention that other curved surfaces or combinations such as cone/hemisphere; or other shapes such as hemisphere with other radii, or other curved surfaces will result in similar performance as that disclosed herein for the preferred biconical dipole element 20.

Figure 17:
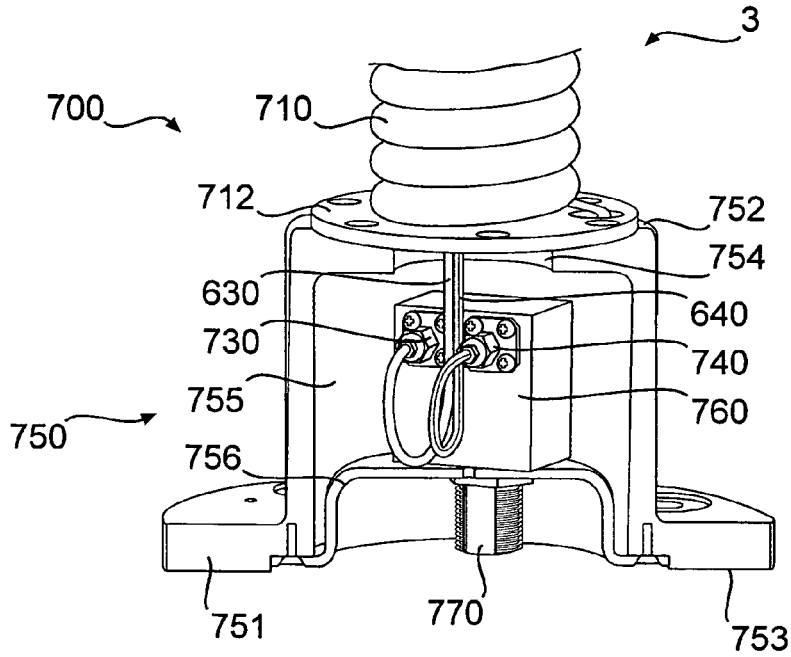
FIG. 17 is a perspective view with partial cross-section of the spring base with diplexer of an ultra-broadband antenna system according to a third embodiment of the present invention.

Referring now to FIG. 17, a second alternate embodiment of the present invention, ultra-broadband antenna system 3 is shown (in part), wherein spring/base sub-assembly 700 (shown in part) preferably further comprises alternate spring base 750. Spring base 750 preferably further comprises top surface 752, bottom surface 753, flange 751, base cavity 755, base aperture 754, conductive plate 756, diplexer 750 and single output connector 770. Top surface 752 is provided at top of spring base 750, and serves as a plane of attachment for spring 710. Flange 751 is provided at bottom of spring base 750, and serves as a plane of attachment to substrate. Bottom surface 753 is provided on underside of flange 751. Base cavity 755 preferably is provided within body of spring base 750, and base aperture 754 is centrally located in top surface 752. Conductive plate 756 preferably is provided within base cavity 755, and may be substantially parallel to top surface 752 and bottom surface 753. Alternatively, conductive plate 756 may be oriented otherwise to fit within the physical envelope of base cavity 755. Diplexer 760 preferably is provided within base cavity 755 and may rest on conductive plate 756. Similar to the description above for the preferred embodiment in connection with FIGS. 11 and 12, high-band coaxial cable 630 and low-band coaxial cable 640 preferably are routed into cavity 755 through base aperture 754. High-band coaxial cable 630 preferably is connected to high-band connector 730, and low-band coaxial cable 640 preferably is connected to low-band connector 740. Both high-band connector 730 and low-band connector 740 are connected to diplexer 760, which combines the RF output from both connectors into single output connector 770. This single output configuration may provide commercial advantages. Connectors 730 and 740 may be Type N, BNC, TNC or selected from other common RF connectors, based on suitability (physical size, cost, power handling, or other practical considerations such as availability or interface to the transceiver box). Spring base 750, including flange 751 and conductive plate 756, may be formed from any appropriate milled, cast, formed or stamped conductive metal, such as aluminum or steel, or other material that provides adequate conductivity, support and rigidity. Conductive plate 756 preferably is supported within cavity of spring base 750 and may be formed from a separate piece of metal, such as aluminum or steel. Conductive plate 756 also serves as the ground return of single output connector 770. Single output connector 770 is also grounded to the host platform, i.e. the substrate to which ultra-broadband antenna system 1 is attached via spring base bottom surface 753 and attachment fasteners 713 (not shown in this view). Diplexer 760 and single output connector 770 may be supplied from commercially-available stock.

Figure 18A:
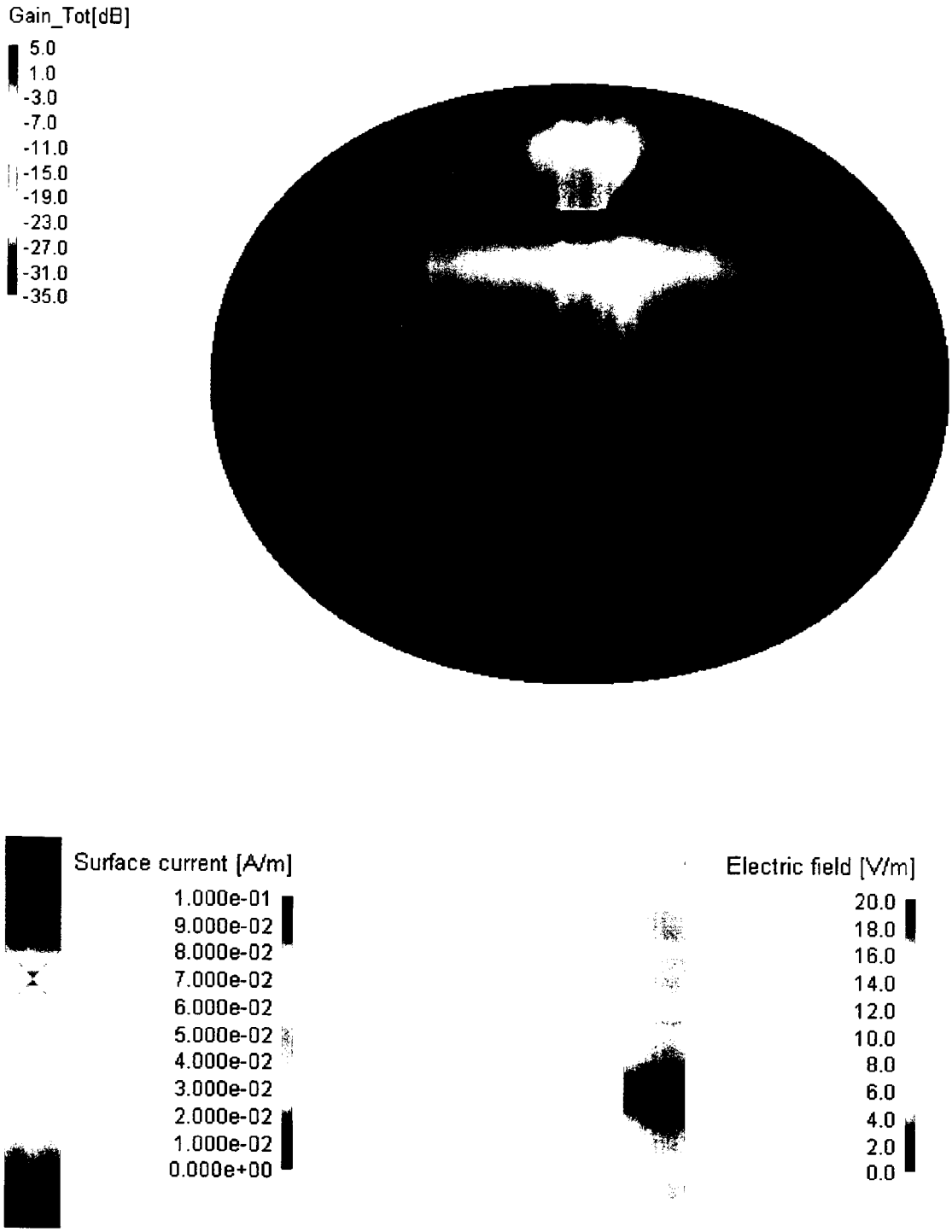
FIG. 18*a* depicts graphs, at 200 MHz, of the 3-D gain radiation pattern, the electric surface current, and the electric field of an ultra-broadband antenna system according to a first embodiment of the present invention.

Referring now to FIG. 18*a*, three graphs depict the 200 MHz 3-D gain radiation pattern, electric surface current, and electric field of a preferred embodiment of ultra-broadband antenna system 1. The patterns exhibit an omni-directional coverage (covering all azimuth angles), and in particular, exhibit strong coverage at angles perpendicular to the antenna system axis. As disclosed herein, ultra-broadband antenna system 1 also exhibits a null along the longitudinal axis of the antenna system, shown as a depression on top of FIG. 18*a*. This null does not affect the desired antenna performance, and in fact, enhances performance.

Figure 18B:
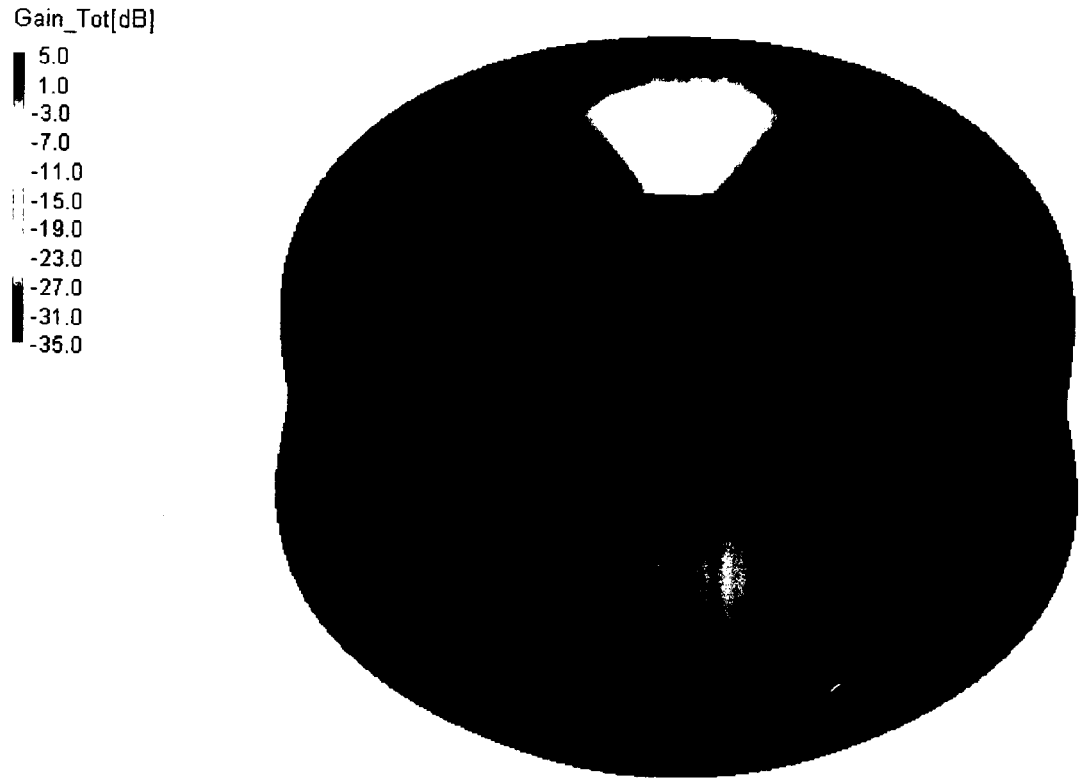
FIG. 18*b* depicts graphs, at 500 MHz, of the 3-D gain radiation pattern, the electric surface current, and the electric field of an ultra-broadband antenna system according to a first embodiment of the present invention.
Figure 18B:
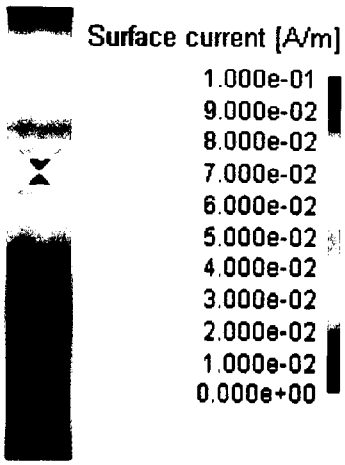
Figure 18B:
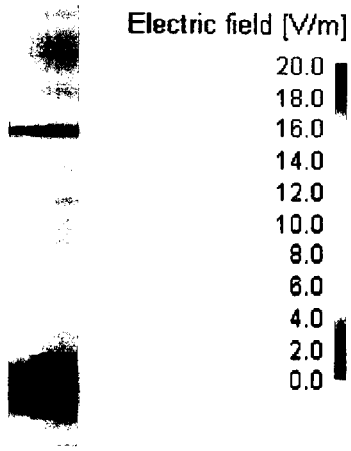

Referring now to FIG. 18*b*, three graphs depict the 500 MHz 3-D gain radiation pattern, electric surface current, and electric field of a preferred embodiment of ultra-broadband antenna system 1. The patterns exhibit an omni-directional coverage (covering all azimuth angles), and in particular, exhibit strong coverage at angles perpendicular to the antenna system axis. As disclosed herein, ultra-broadband antenna system 1 also exhibits a null along the longitudinal axis of the antenna system, shown as a depression on top of FIG. 18*b*. This null does not affect the desired antenna performance, and in fact, enhances performance. The subtle lobes of the pattern are a key attribute of the antenna system performance. Although the pattern coverage is somewhat modulated, there are no substantial or deep nulls in the spherical region of the pattern.

Figure 18C:
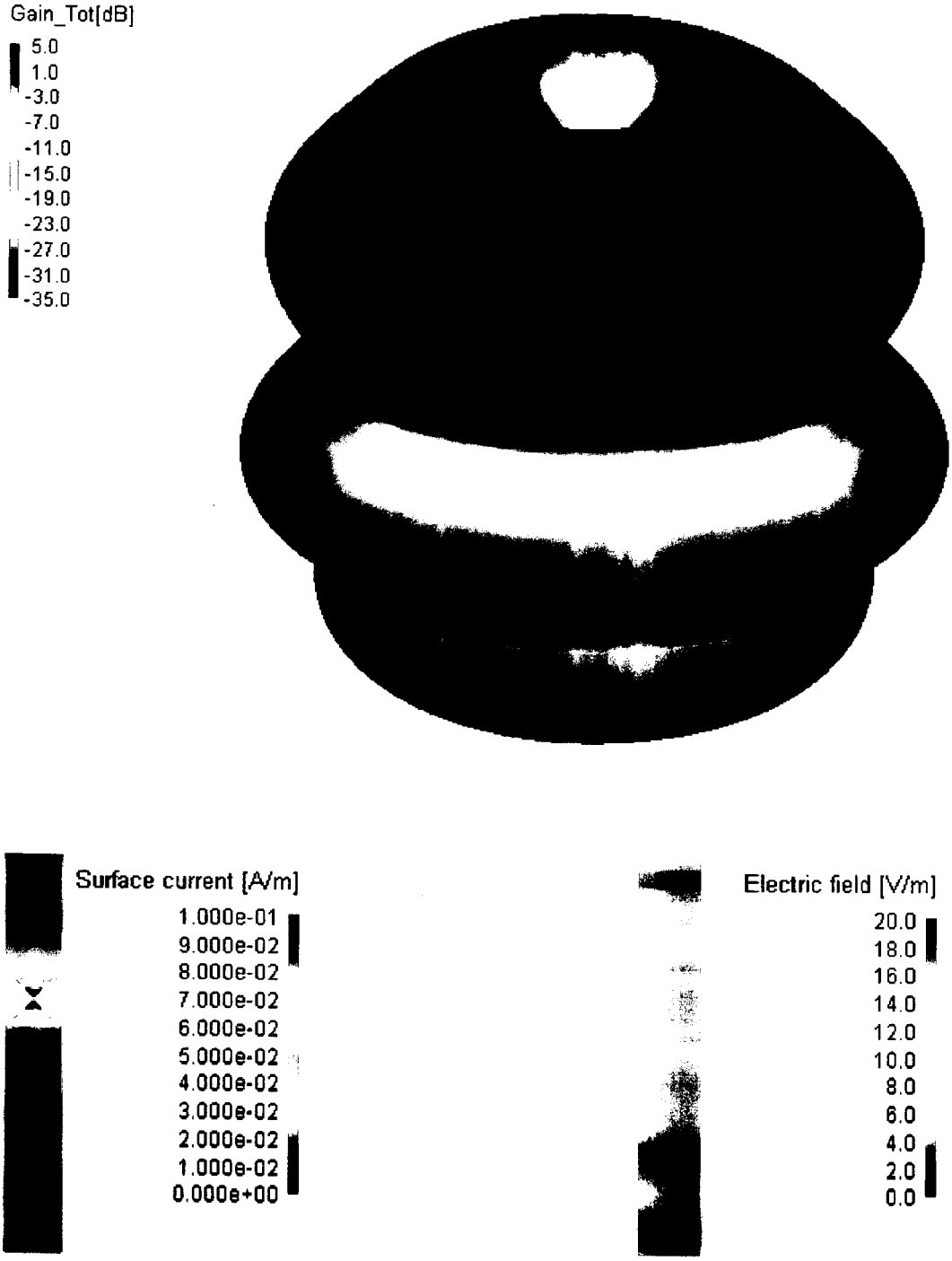
FIG. 18*c* depicts graphs, at 1000 MHz, of the 3-D gain radiation pattern, the electric surface current, and the electric field of an ultra-broadband antenna system according to a first embodiment of the present invention.

Referring now to FIG. 18*c*, three graphs depict the 1000 MHz 3-D gain radiation pattern, electric surface current, and electric field of a preferred embodiment of ultra-broadband antenna system 1 The patterns exhibit an omni-directional coverage (covering all azimuth angles), and in particular, exhibit strong coverage at angles perpendicular to the antenna system axis. As disclosed herein, ultra-broadband antenna system 1 also exhibits a null along the longitudinal axis of the antenna system, shown as a depression on top of FIG. 18*c*. This null does not affect the desired antenna performance, and in fact, enhances performance. The lobes of the pattern are a key attribute of the antenna performance. Although the pattern coverage is somewhat modulated, there are no substantial or deep nulls in the spherical region of the pattern.

Figure 18D:
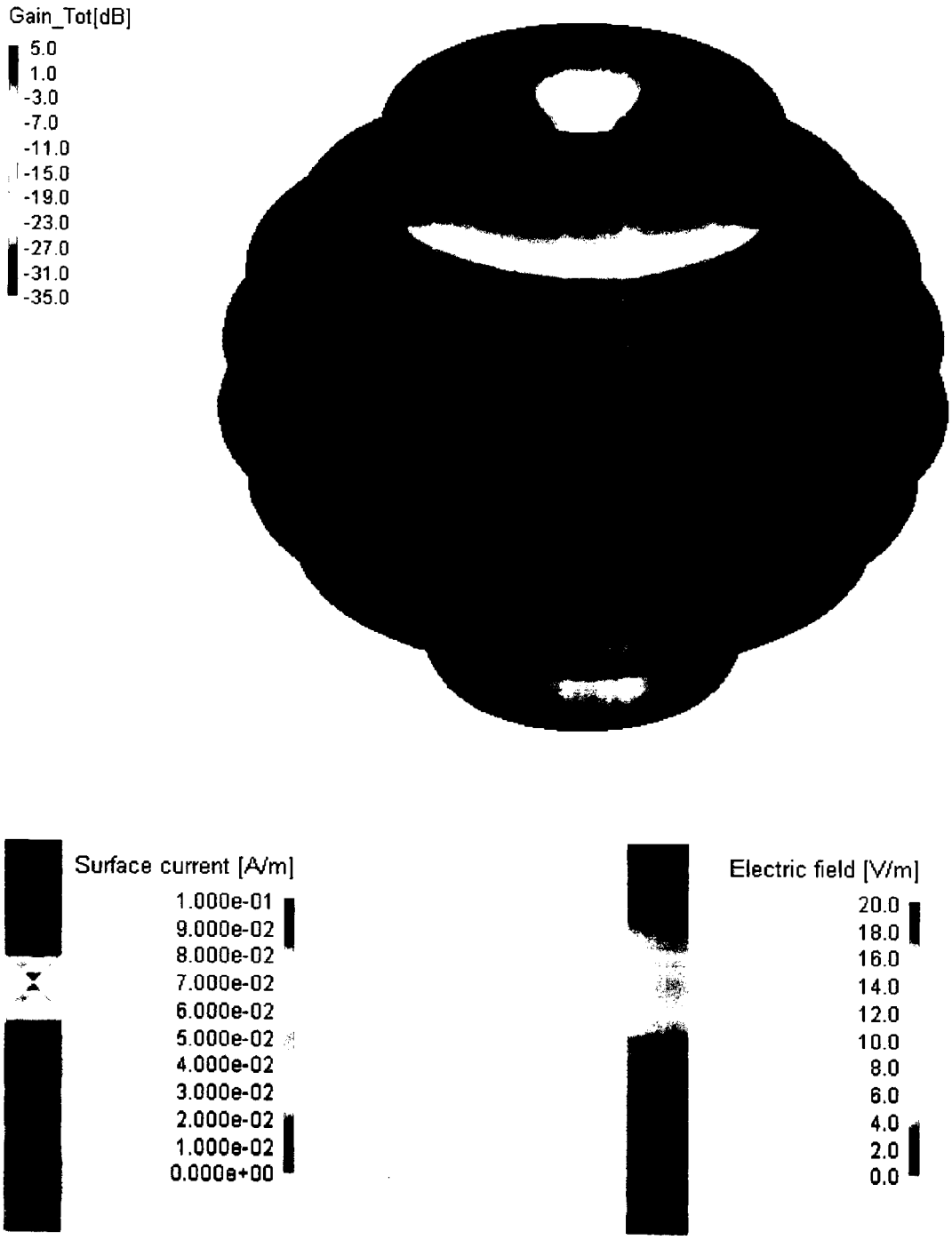
FIG. 18*d* depicts graphs, at 2500 MHz, of the 3-D gain radiation pattern, the electric surface current, and the electric field of an ultra-broadband antenna system according to a first embodiment of the present invention.

Referring now to FIG. 18*d*, three graphs depict the 2500 MHz 3-D gain radiation pattern, electric surface current, and electric field of a preferred embodiment of ultra-broadband antenna system 1. The patterns exhibit an omni-directional coverage (covering all azimuth angles), and in particular, exhibit strong coverage at angles perpendicular to the antenna system axis. As disclosed herein, ultra-broadband antenna system 1 also exhibits a null along the longitudinal axis of the antenna system, shown as a depression on top of FIG. 18*d*. This null does not affect the desired antenna performance, and in fact, enhances performance. The lobes of the pattern are a key attribute of the antenna performance. Although the pattern coverage is somewhat modulated, there are no substantial or deep nulls in the spherical region of the pattern. At higher frequencies, more lobes are apparent but the ultra-broadband antenna system does not exhibit nulls in the spherical region of the pattern that affect performance.

Figure 18E:
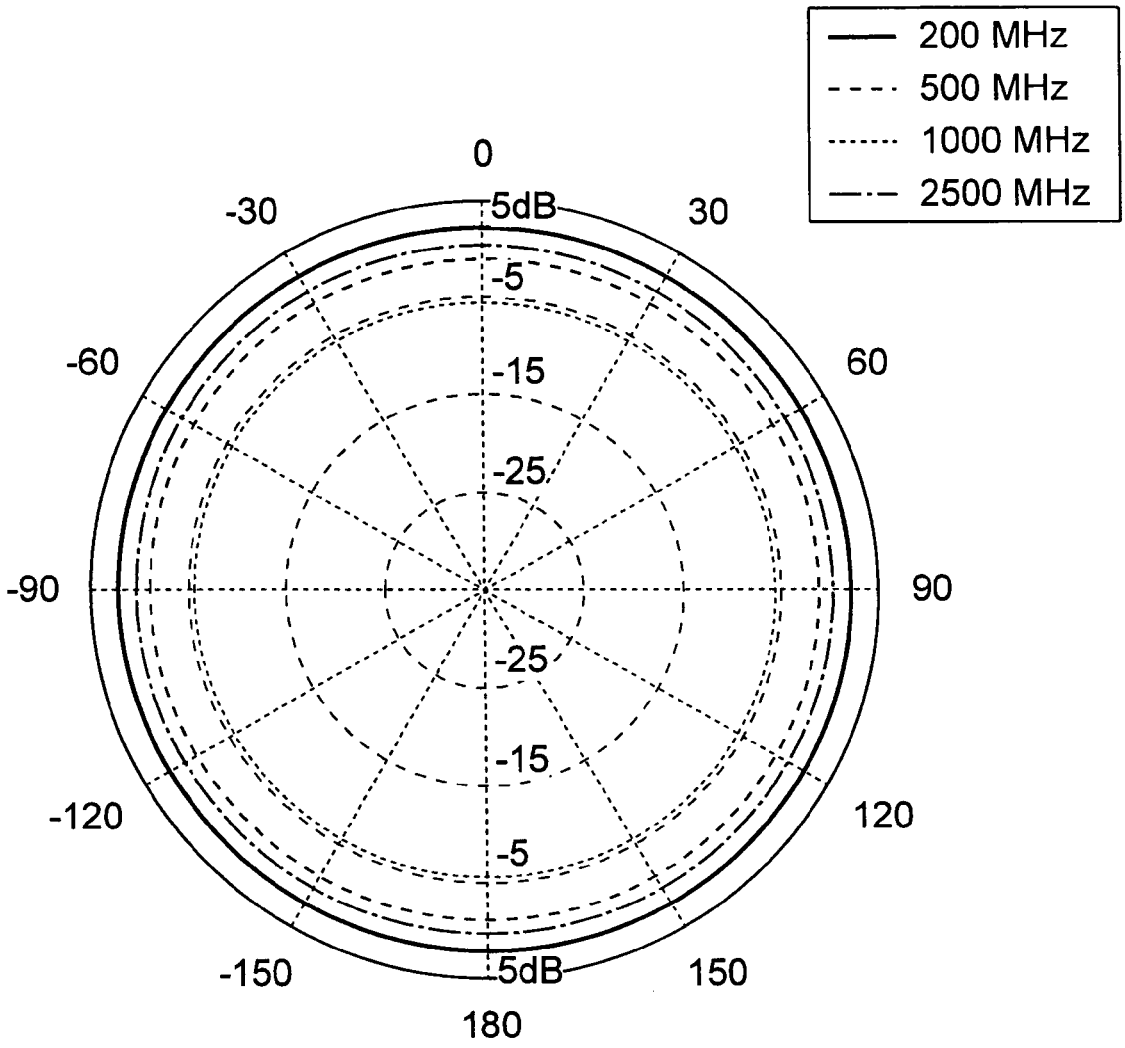
FIG. 18*e* depicts a graph, at 200, 500, 1000 and 2500 MHz, of the azimuth radiation pattern of an ultra-broadband antenna system according to a first embodiment of the present invention.

Referring now to FIG. 18*e*, a graph depicts the azimuth radiation pattern of a preferred embodiment of ultra-broadband antenna system 1 at 200, 500, 1000 and 2500 MHz. A key attribute of the disclosed ultra-broadband antenna system is the omni-directional coverage. This is shown by the circular patterns indicating equal coverage at all azimuthal angles.

Figure 18F:
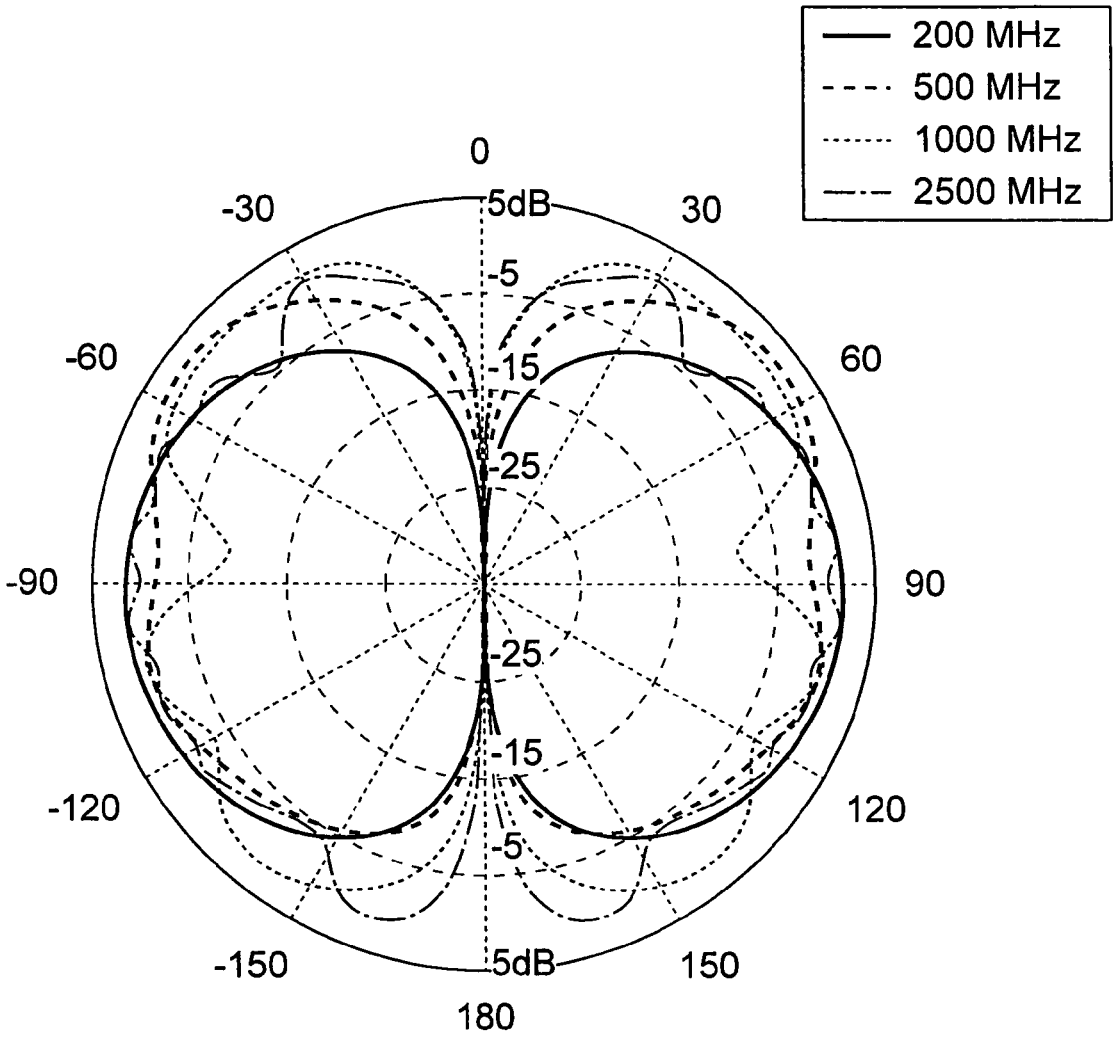
FIG. 18*f* depicts a graph, at 200, 500, 1000 and 2500 MHz, of the elevation radiation pattern of an ultra-broadband antenna system according to a first embodiment of the present invention.

Referring now to FIG. 18*f*, a graph depicts the elevation radiation pattern of a preferred embodiment of ultra-broadband antenna system 1 at 200, 500, 1000 and 2500 MHz. This figure shows a composite pattern in elevation of the ultra-broadband antenna system (described above in connection with the 3D projections shown in FIGS. 18*a, b, c* and *d*). A key attribute of the antenna system is coverage at angles perpendicular to the longitudinal axis of the antenna. The longitudinal axis is along 0/180 degrees.

It will be apparent to those skilled in that art that various modifications and variations can be made in the fabrication and configuration of the present invention without departing from the scope and spirit of the invention. For example, the design of the present invention is scalable, and may be modified to expand high band coverage to approximately 20 GHz or even greater, by truncating the point of the biconical antenna cones to yet a finer point than that depicted herein. As mentioned above, the biconical antenna cones may be any of a variety of monotonically increasing or decreasing shapes.

As another variation, the ultra-broadband antenna system of the present invention may be attached to substrates other than vehicles, such as buildings, flag poles, ships, boats, may be deployed on aircraft, or may be handheld. Further, the antenna system may be provided without the spring mounting. The antenna system of the present invention may be mounted vertically as shown herein, or may be mounted in other orientations, such as horizontally on the side, bottom or top of a structure, or inside a vehicle or other structure comprising non-interfering material.

In addition, a variety of materials may be used to fabricate the components of the apparatus of the invention. For example, stealth materials, such as carbon-based compounds, may be used in order to reduce detection. The conductor surfaces may be replaced with frequency-selective surfaces whereby the surfaces act as conductors in selected frequency bands and also act as RF reactance (non-perfect conductors) at other bands.

As embodied herein, the antenna system of the present invention may be connected to various types of RF transceivers or transponders, such as radios, GPS receivers or radars. Thus, the antenna system of the present invention may be used for a wide variety of applications in RF transmission and reception, navigation and/or communication. Thus, it is intended that the present invention cover the modifications and variations of the invention provided they come within the scope of the appended claims and their equivalents.

What is claimed is:

1. An ultra-broadband antenna system comprising a single tubular antenna structure, wherein said antenna structure further comprises:

an asymmetrical dipole antenna;

a biconical dipole antenna; and a combination of said asymmetrical dipole antenna and said biconical dipole antenna such that said combination forms a monopole antenna.

2. The ultra-broadband antenna system according to claim 1, wherein said combination further comprises a canister sub-assembly that provides frequency adjustment for said monopole antenna, and wherein said canister sub-assembly is attached to said asymmetrical dipole antenna.

3. The ultra-broadband antenna system according to claim 2, wherein said combination further comprises a choke sub-assembly that minimizes inference between said asymmetrical dipole antenna, said biconical dipole antenna and said monopole antenna, and wherein said choke sub-assembly is provided within said canister sub-assembly.

4. The ultra-broadband antenna system according to claim 3, wherein said combination further comprises a balun sub-assembly that feeds current to said asymmetrical dipole antenna and said biconical dipole antenna together via a first RF connection, and wherein said balun sub-assembly is provided within said asymmetrical dipole antenna.

5. The ultra-broadband antenna system according to claim 4, wherein said combination further comprises a base sub-assembly that attaches said system to a substrate and provides a conductive path for ground return currents of said monopole antenna, and wherein said base sub-assembly is attached to said canister sub-assembly.

6. The ultra-broadband antenna system according to claim 5, wherein said combination further comprises a second RF connection that feeds current to said monopole antenna.

7. The ultra-broadband antenna system according to claim 6, wherein said canister sub-assembly further comprises:

a cylinder expander ring that insulates said asymmetrical dipole element and said biconical dipole element electrically from said monopole antenna; and a dielectric isolator that insulates said base sub-assembly from said monopole antenna.

8. The ultra-broadband antenna system according to claim 7, wherein said system provides a bandwidth greater than 500:1.

9. The ultra-broadband antenna system according to claim 8, wherein said biconical dipole antenna further comprises a first cone, a second cone and at least one spacer rod.

10. The ultra-broadband antenna system according to claim 8, wherein said biconical dipole antenna further comprises a first hemisphere, a second hemisphere and at least one spacer rod.

11. The ultra-broadband antenna system according to claim 8, wherein said base sub-assembly further comprises a conductive spring that flexibly supports said system.

12. The ultra-broadband antenna system according to claim 8, wherein said first RF connection is fed to a high-band connector and therefrom to a first transceiver, and said second RF connection is fed to a low-band connector and therefrom to a second transceiver.

13. The ultra-broadband antenna system according to claim 8, wherein said first RF connection is fed to a high-band connector and therefrom to a diplexer, and said second RF connection is fed to a low-band connector and therefrom to said diplexer, and wherein return current flows from said diplexer via a single output connector to a transceiver.

14. A method for providing an ultra-broadband antenna system, comprising the following steps:

providing a single tubular antenna structure;

providing an asymmetrical dipole antenna contained within said antenna structure;

providing a biconical dipole antenna contained within said antenna structure; and providing a combination of said asymmetrical dipole antenna and said biconical dipole antenna such that said combination forms a monopole antenna within said antenna structure.

15. The method according to claim 14, further comprising the following steps:

providing a canister sub-assembly for frequency adjustment of said monopole antenna;

providing a choke sub-assembly for minimizing inference between said asymmetrical dipole antenna, said biconical dipole antenna and said monopole antenna;

providing a balun sub-assembly for feeding current to said asymmetrical dipole antenna and said biconical dipole antenna together via a first RF connection;

providing a base sub-assembly for attaching said system to a substrate and providing a conductive path for ground return currents of said monopole antenna;

providing a second RF connection for feeding current to said monopole antenna;

providing a cylinder expander ring for insulating said asymmetrical dipole element and said biconical dipole element electrically from said monopole antenna; and providing a dielectric isolator for insulating said base sub-assembly from said monopole antenna.

16. The method according to claim 15, further comprising the step of providing a bandwidth greater than 500:1.

17. The method according to claim 16, further comprising the step of providing a first cone, a second cone and at least one spacer rod for generating electrical activity via said biconical dipole antenna.

18. The method according to claim 16, further comprising the step of providing a first hemisphere, a second hemisphere and at least one spacer rod for generating electrical activity via said biconical dipole antenna.

19. The method according to claim 16, further comprising the step of providing a conductive spring in said base sub-assembly for flexibly supporting said system.

20. The method according to claim 16, further comprising the following steps:

providing a high-band connector for feeding said first RF connection and a first transceiver, and providing a low-band connector for feeding said second RF connection and a second transceiver.

21. The method according to claim 16, further comprising the following steps:

providing a high-band connector for feeding said first RF connection, providing a low-band connector for feeding said second RF connection, and providing a diplexer for connecting to said high-band connector and to said low-band connector, wherein return current flows from said diplexer via a single output connector to a transceiver.

* * * * *